US012460856B2

(12) United States Patent
Son et al.

(10) Patent No.: US 12,460,856 B2
(45) Date of Patent: Nov. 4, 2025

(54) REFRIGERATOR

(71) Applicant: SAMSUNG ELECTRONICS CO., LTD., Suwon-si (KR)

(72) Inventors: Jonghyun Son, Suwon-si (KR); Byoungmok Kim, Suwon-si (KR); Seongwoo Kim, Suwon-si (KR); Taecheol Park, Suwon-si (KR); Younttae Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 80 days.

(21) Appl. No.: 18/131,554

(22) Filed: Apr. 6, 2023

(65) Prior Publication Data

US 2023/0243575 A1 Aug. 3, 2023

Related U.S. Application Data

(63) Continuation of application No. PCT/KR2021/014420, filed on Oct. 15, 2021.

(30) Foreign Application Priority Data

Nov. 18, 2020 (KR) ..... 10-2020-0154990
Jun. 22, 2021 (KR) ..... 10-2021-0081005

(51) Int. Cl.
*F25D 23/02* (2006.01)

(52) U.S. Cl.
CPC ..... *F25D 23/028* (2013.01)

(58) Field of Classification Search
CPC .... F25D 23/028; F25D 2400/18; F25D 23/02; F25D 23/085; A47F 3/0434; A47F 3/043; E05Y 2900/31
See application file for complete search history.

(56) References Cited

U.S. PATENT DOCUMENTS 3,525,190 A 8/1970 Saunders et al.
5,358,326 A 10/1994 Cherry et al.
(Continued)

FOREIGN PATENT DOCUMENTS

CN 102985773 A * 3/2013 ..... F25D 23/02
DE 7539876 4/1976
(Continued)

OTHER PUBLICATIONS

DE7539876U translation (Year: 1976).*
(Continued)

*Primary Examiner* — Hiwot E Tefera
(74) *Attorney, Agent, or Firm* — STAAS & HALSEY LLP

(57) ABSTRACT

A refrigerator includes a main body having a storage chamber within the main body; and a door. The door includes: a door body having insulation inside the door body, the door body being rotatably coupled to the main body so that the door is rotatable to open and close the storage chamber; a door panel which detachably coupled to the front of the door body and forming a front surface of the door; a trim installing classis which is detachably mounted to the door body so as and forming a side surface of the door, the trim installing chassis includes a trim coupling portion protruding outward from the door body and the door panel; and a deco trim which is mounted to the trim coupling portion and forming an edge of the door, wherein the door panel and the deco trim together form a front outer appearance of the door.

16 Claims, 37 Drawing Sheets

(56) References Cited

U.S. PATENT DOCUMENTS

| | | | | |
|---|---|---|---|---|
| 5,520,453 | A | 5/1996 | Aoki et al. | |
| 8,104,853 | B2 | 1/2012 | Kim et al. | |
| 8,523,304 | B2 | 9/2013 | Kim | |
| 9,528,748 | B2 * | 12/2016 | Joo | F25D 23/02 |
| 10,018,218 | B2 | 7/2018 | Jung | |
| 10,098,456 | B2 | 10/2018 | Beni et al. | |
| 10,480,240 | B2 | 11/2019 | Toll et al. | |
| 11,287,174 | B2 | 3/2022 | Lee et al. | |
| 2005/0006997 | A1 * | 1/2005 | Yoshioka | F25D 23/02 312/405 |
| 2005/0257495 | A1 * | 11/2005 | Choi | F25D 23/02 52/784.1 |
| 2008/0036350 | A1 * | 2/2008 | Crompton | F25D 23/02 312/405 |
| 2008/0042537 | A1 | 2/2008 | Kim et al. | |
| 2008/0120912 | A1 * | 5/2008 | Crompton | F25D 23/028 49/372 |
| 2008/0143227 | A1 * | 6/2008 | Kim | F25D 23/02 312/405 |
| 2009/0045705 | A1 | 2/2009 | Laible et al. | |
| 2010/0270901 | A1 * | 10/2010 | Kim | F25D 23/02 312/405 |
| 2011/0273071 | A1 * | 11/2011 | Kim | F25D 23/028 312/405 |
| 2012/0326587 | A1 * | 12/2012 | Jeong | F25D 23/02 312/405 |
| 2016/0209110 | A1 * | 7/2016 | Cho | F25D 23/062 |
| 2017/0146281 | A1 * | 5/2017 | Ding | E05B 1/04 |
| 2017/0184336 | A1 * | 6/2017 | Becke | F25D 23/028 |
| 2021/0055038 | A1 * | 2/2021 | Lee | F25C 5/22 |

FOREIGN PATENT DOCUMENTS

| | | | | |
|---|---|---|---|---|
| DE | 102010027921 | A1 * | 10/2011 | F25D 23/02 |
| DE | 102017217632 | A1 * | 4/2019 | F25D 23/028 |
| EP | 2843329 | A2 * | 3/2015 | F25D 23/028 |
| FR | 2478727 | A * | 9/1981 | F25D 23/02 |
| JP | 45-22915 | | 9/1970 | |
| JP | 59-145691 | | 9/1984 | |
| JP | 59-145693 | | 9/1984 | |
| JP | 61-127390 | | 8/1986 | |
| JP | 5-126461 | | 5/1993 | |
| JP | 6567075 | | 8/2019 | |
| KR | 2003-0058178 | | 7/2003 | |
| KR | 2003-0065904 | | 8/2003 | |
| KR | 10-2005-0099051 | | 10/2005 | |
| KR | 10-2006-0110566 | | 10/2006 | |
| KR | 10-0730893 | | 6/2007 | |
| KR | 10-2007-0068933 | | 7/2007 | |
| KR | 10-0828325 | | 5/2008 | |
| KR | 20-0461789 | | 8/2012 | |
| KR | 10-1262370 | | 5/2013 | |
| KR | 10-1339925 | | 12/2013 | |
| KR | 10-1346502 | | 12/2013 | |
| KR | 10-2014-0062422 | | 5/2014 | |
| KR | 10-2015-0061213 | | 6/2015 | |
| KR | 10-1728730 | | 4/2017 | |
| KR | 10-2312667 | | 10/2021 | |

OTHER PUBLICATIONS

English translation for JPS59145691 (Year: 1984).*
DE-102017217632-A1 translation (Year: 2019).*
JPH0514140 translation (Year: 1993).*
International Search Report dated Feb. 10, 2022 issued in PCT Application No. PCT/KR2021/014420.
Written Opinion dated Feb. 10, 2022 issued in PCT Application No. PCT/KR2021/014420.
Office Action dated Dec. 8, 2023 issued in European Application No. EP 21 89 4894.
Office Action dated Jul. 17, 2025, in Chinese Application No. CN 202180070161.6.
Office Action dated Jul. 3, 2025, in European Application No. 21 894 894.1.

* cited by examiner

REFRIGERATOR

CROSS-REFERENCE TO RELATED APPLICATION(S)

This application is a continuation of International Application No. PCT/KR2021/014420, filed on Oct. 15, 2021, and claims priority to Korean Patent Application Nos. 10-2020-0154990, filed on Nov. 18, 2020, and 10-2021-0081005, filed Jun. 22, 2021, in the Korean Intellectual Property Office, the disclosures of all of which are incorporated by reference herein in their entireties.

BACKGROUND

1. Field

The present disclosure relates to a refrigerator, and more particularly, to a refrigerator having an improved door structure.

2. Description of Related Art

A refrigerator is equipment for keeping food fresh by including a main body having a storage chamber and a cool air supply system for supplying cool air to the storage chamber. The storage chamber includes a refrigerating chamber that is maintained at about 0° C. to 5° C. to keep foods refrigerated and a freezing chamber that is maintained at about 0° C. to 30° C. below zero to keep foods frozen. Generally, the front side of the storage chamber opens to put foods therein or take foods out, and the open front side of the storage chamber is opened and closed by a door.

Refrigerators are classified according to the positions of the storage chambers and the types of the doors. That is, refrigerators are classified into a Top Mounted Freezer (TMF) type refrigerator in which a storage chamber is partitioned in an up-down direction by a horizontal partition wall to form a freezing chamber in the upper space and a refrigerating chamber in the lower space, a Bottom Mounted Freezer (BMF) type refrigerator in which a refrigerating chamber is formed in the upper space and a freezing chamber is formed in the lower space, and a refrigerator including only a refrigerating chamber or a freezing chamber. Also, there are a Side by Side (SBS) type refrigerator in which a storage chamber is partitioned in a left-right direction by a vertical partition wall to form a freezing chamber in one side and a refrigerating chamber in the other side, and a French Door Refrigerator (FDR) type refrigerator in which a storage chamber is partitioned in an up-down direction by a horizontal partition wall to form a refrigerating chamber in the upper space and a freezing chamber in the lower space and the refrigerating chamber is opened and closed by a pair of doors.

Recently, there are many cases of installing such various kinds of a plurality of refrigerators side by side.

SUMMARY

A refrigerator according to a concept of the disclosure includes: a main body having a storage chamber within the main body; and a door including: a door body having an insulation inside the door body, the door body being rotatably coupled to the main body so that the door is rotatable to open and close the storage chamber; a door panel detachably coupled to a front portion of the door body and forming a front surface of the door; a trim installing chassis detachably coupled to the door body and forming a side surface of the door, the trim installing chassis including a trim coupling portion protruding outward from the door body and the door panel; and a deco trim coupled to the trim coupling portion and forming an edge of the door, wherein the door panel and the deco trim together form a front outer appearance of the door.

Also, the refrigerator, wherein the trim coupling portion may include a protrusion inserting groove, and the deco trim includes a guide protrusion which is inserted into the protrusion inserting groove so that the deco trim is slidingly coupled to the trim installing chassis.

Also, the edge formed by the deco trim is a side edge of the door, and the deco trim may extend along a direction of a rotation axis on which the door rotates.

Also, the door body may include: a cover plate positioned behind the door panel and forming a front surface and a side surface of the door body, and so that the trim installing chassis is coupled to a side of the cover plate; and a rear unit positioned behind the cover plate and forming a rear surface of the door body.

Also, the door body may further include a side chassis including a side portion forming another side surface of the door opposite the trim installing chassis between the rear unit and the cover plate.

Also, one side of the cover plate may be coupled to the rear unit to form the side surface of the door body, and another side of the cover plate may be coupled to the side chassis.

Also, the side chassis may include a handle portion depressed from the side portion toward inside of the door.

Also, the cover plate may include: a chassis coupling portion to which the trim installing chassis is coupled; and an extension portion extending in a rear direction from the chassis coupling portion to form the side surface of the door body or the surface opposite the side surface of the door body.

Also, the trim installing chassis may include a cover coupling portion coupled to the chassis coupling portion, and the trim coupling portion may extend outward from the cover coupling portion and protrude in a side direction from the extension portion of the cover plate.

Also, the trim installing chassis may include a side portion extending from the trim coupling portion to be parallel to the extension portion of the cover plate, and forming the one side surface of the door.

Also, the trim installing chassis may include a chassis fixing portion bent from the side portion toward inside of the door, and the chassis fixing portion includes an end portion that may be inserted in the rear unit.

Also, the rear unit may include a rear frame including a support groove depressed in a rear portion of the rear frame, so that the chassis fixing portion of the trim installing chassis may be inserted in the support groove.

Also, the door panel may include: a side trim extending toward the door body, and wherein the trim installing chassis may include a panel fixing portion extending in a front direction from the cover coupling portion, contacting the side trim, so as to fix a location of the door panel with respect to the door body.

Also, the door of the refrigerator may further include a sub trim to cover upper portions of the trim installing chassis and the deco trim.

Also, the door body may include a plurality of side chassis forming opposite side surfaces of the door, each side chassis of the plurality of side chassis includes a handle portion depressed to inside of the door, so that the trim installing chassis may be coupled to the handle portion of each side chassis of the plurality of side chassis.

A refrigerator according to another concept of the disclosure includes: a main body including a storage chamber; and a door rotatably coupled to the main body and configured to open and close the storage chamber, wherein the door includes: a door body including a side chassis forming one side surface of the door, wherein an insulation is provided inside the door body; a door panel detachably coupled to a front portion of the door body; and a chassis unit positioned at side portions of the door body and the door panel to form another side surface of the door, wherein the chassis unit includes: a trim installing chassis coupled to the door body and including a trim coupling portion protruding in a side direction of the door body; and a deco trim including a deco portion connected to the trim installing chassis to cover a front portion of the trim coupling portion and forming a side edge of the door panel.

Also, the deco trim may include: a projection portion extending in a rear direction from the deco portion and fixed to an inner portion of the trim coupling portion of the trim installing chassis; and a guide protrusion extending in the rear direction from the deco portion and inserted in the trim coupling portion.

Also, the door body may include a sub trim installed to cover upper portions of the trim installing member and the deco trim.

A refrigerator according to another concept of the disclosure includes: a main body including a storage chamber; and a door rotatably coupled to the main body and configured to open and close the storage chamber, wherein the door includes: a door body in which an insulation is foamed; a trim installing chassis coupled to the door body to form one side surface of the door, and including a trim coupling portion; a deco trim slidingly coupled to the trim coupling portion and forming a side edge of the door; and a door panel positioned in front of the door body and forming a front surface of the door together with the deco trim.

Also, the trim installing chassis may include a chassis fixing portion bent to a rear inner portion of the door body and caught by and installed on a rear surface of the door body.

DETAILED DESCRIPTION

Figure 1:
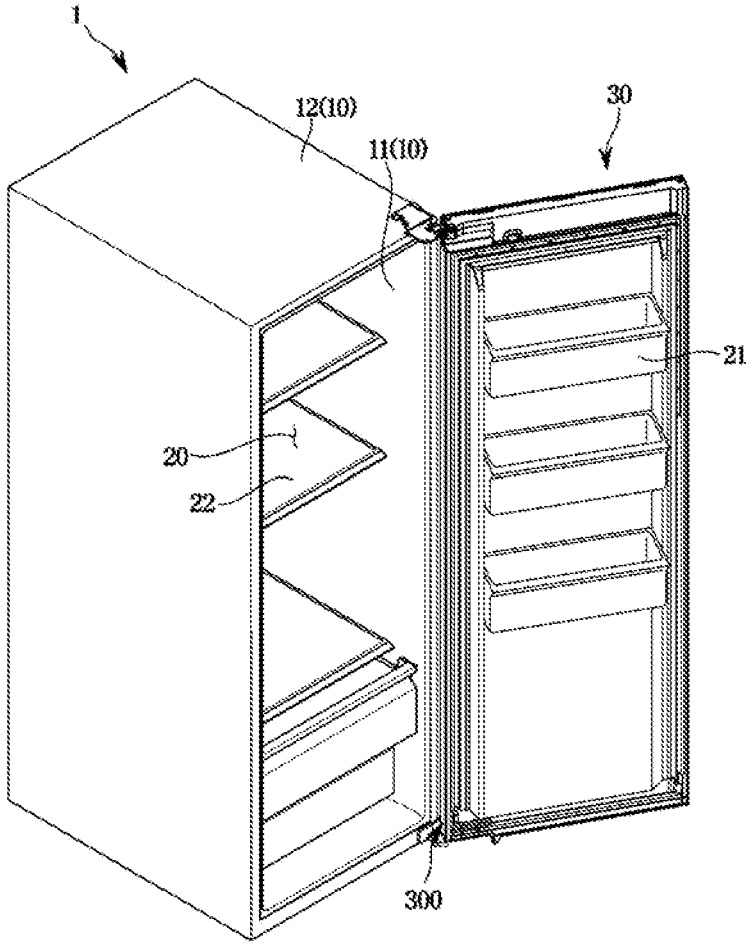
FIG. 1 is a perspective view of a refrigerator according to an embodiment of the disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe the embodiments, and are not intended to limit and/or restrict the disclosure. An expression used in the singular encompasses the expression of the plural, unless it has a clearly different meaning in the context. In the present specification, it is to be understood that the terms such as "comprising", "including" or "having", etc., are intended to indicate the existence of the features, numbers, steps, operations, components, parts, or combinations thereof disclosed in the specification, and are not intended to preclude the possibility that one or more other features, numbers, steps, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, an embodiment of the disclosure will be described in detail with reference to the accompanying drawings.

An aspect of the disclosure provides a refrigerator having a sense of unity between a plurality of refrigerators installed in a line.

Another aspect of the disclosure provides a refrigerator in which a side surface of a main body is aligned with a side surface of a refrigerator door.

A plurality of refrigerators may be arranged with a sense of unity, like a single refrigerator, thereby improving an esthetic sense.

By detachably providing a chassis unit in which a deco trim is installed in a door body, a location of the deco trim may change according to an arrangement of a refrigerator.

FIG. 1 is a perspective view of a refrigerator according to an embodiment of the disclosure.

Referring to FIG. 1, a refrigerator 1 may include a main body 10, a storage chamber 20 provided inside the main body 10, a door 30 for opening and closing the storage chamber 20, and a cool air supply device (not shown) for supplying cool air to the storage chamber 20.

The main body 10 may include an inner case 11 forming the storage chamber 20, an outer case 12 coupled to an outer side of the inner case 11 and forming an outer appearance, and a main body insulation (not shown) foamed between the inner case 11 and the outer case 12 to insulate the storage chamber 20. The main body 10 may include the storage chamber 20.

The cool air supply device may generate cool air by using a cooling circulation cycle of compressing, condensing, expanding, and evaporating a refrigerant.

In the refrigerator 1 according to an embodiment of the disclosure, as shown in FIG. 1, a single door 30 may be provided to open and close a single storage chamber 20. However, the refrigerator 1 is not limited to this type.

Inside the storage chamber 20, a plurality of shelves 22 may be provided to store food, etc.

The storage chamber 20 may be used as a refrigerating chamber or a freezing chamber. However, the storage chamber 20 may be divided into a refrigerating chamber and a freezing chamber by being partitioned by a separate partition.

Accordingly, the storage chamber 20 may be provided as an example, and the storage chamber 20 may be a type that is different from that described above.

The storage chamber 20 may be opened or closed by the door 30. The door 30 may open and close the opening of the main body 10. More specifically, the door 30 may be rotatably coupled to the main body 10 to open and close the storage chamber 20.

A door shelf 21 for accommodating food may be provided on a rear surface of the door 30.

Figure 2:
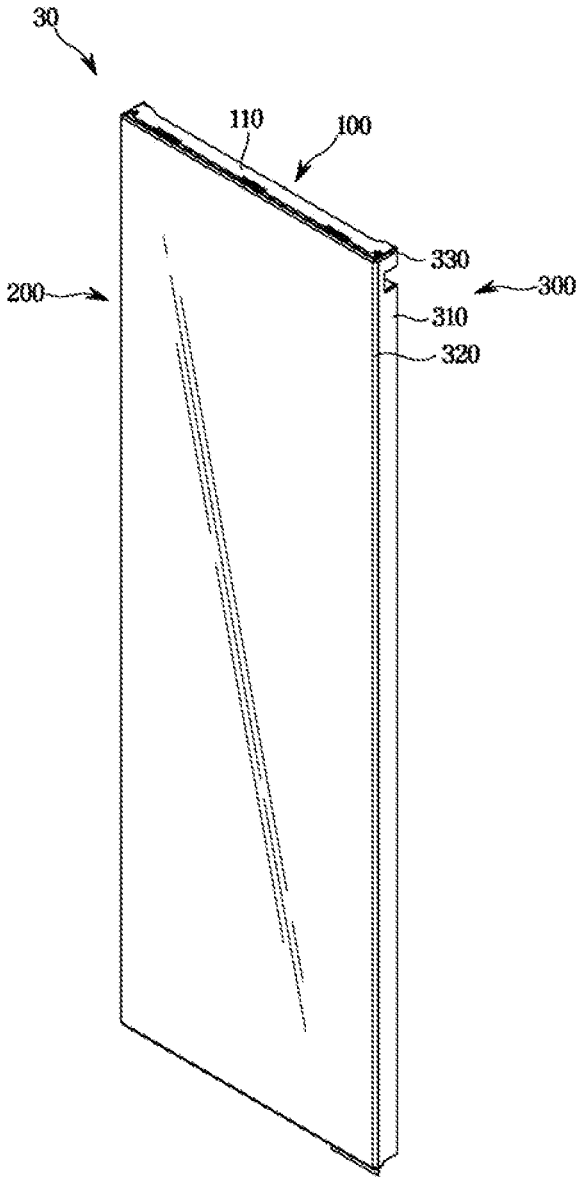
FIG. 2 is a perspective view of a door shown in FIG. 1.
Figure 3:
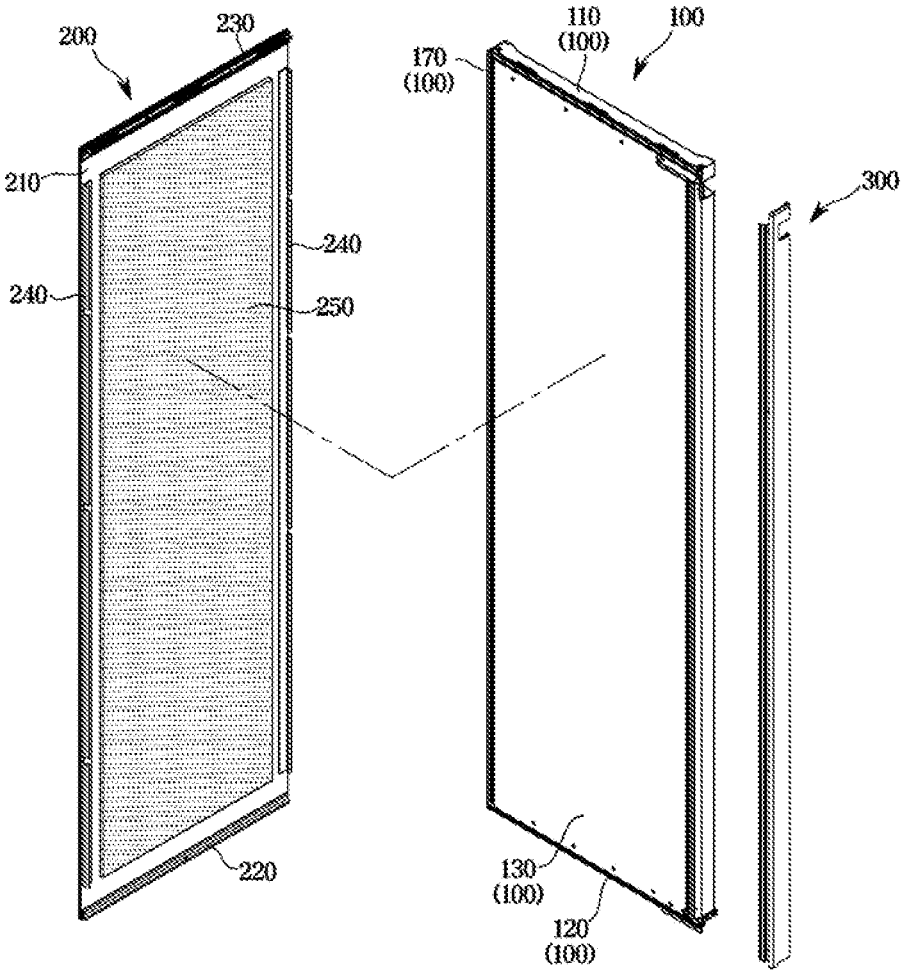
FIG. 3 is an exploded view of a door body, a door panel, and a chassis unit of the door shown in FIG. 2.
Figure 4:
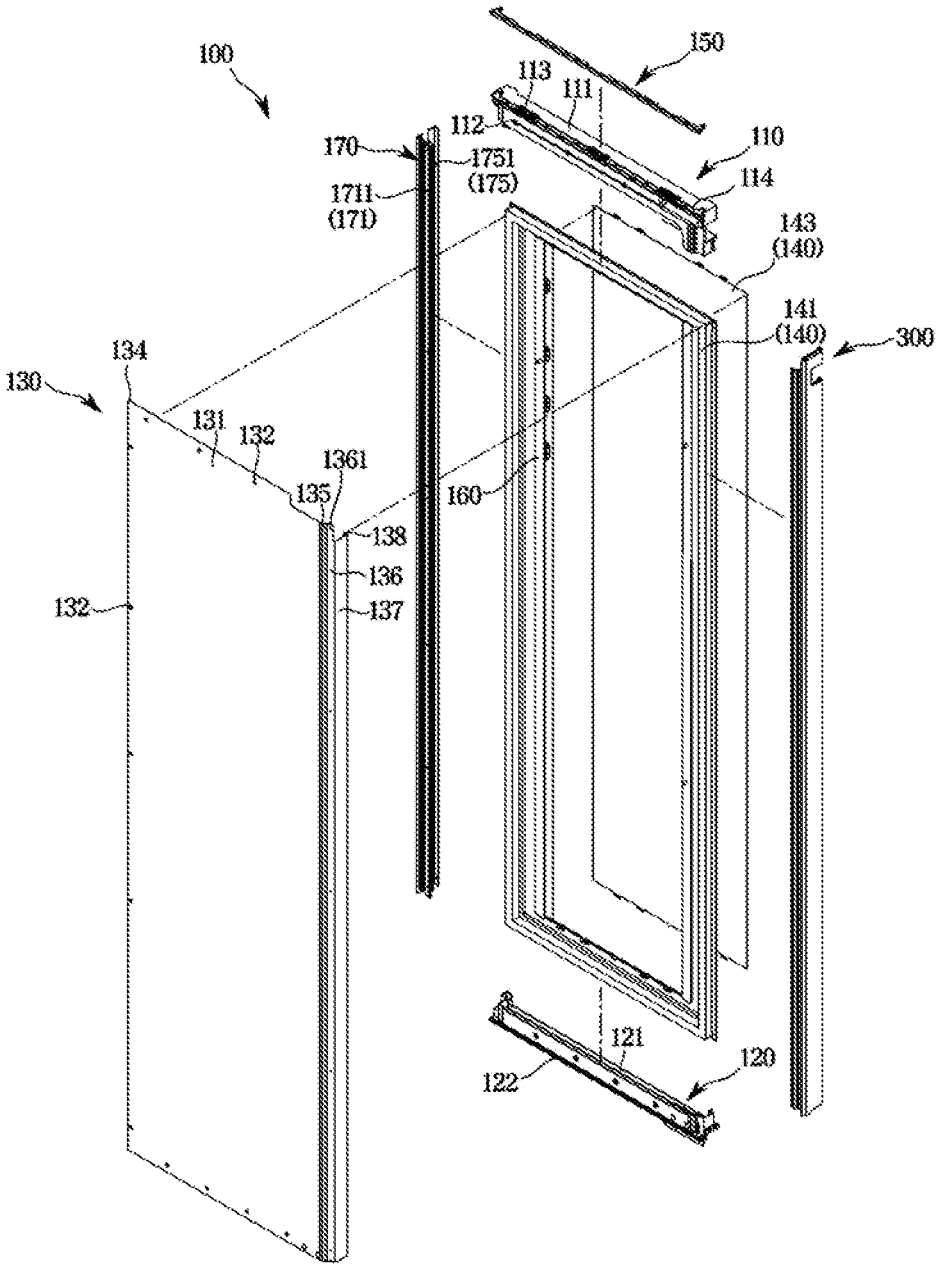
FIG. 4 is an exploded perspective view of the door body shown in FIG. 3 and shows a chassis unit.
Figure 5:
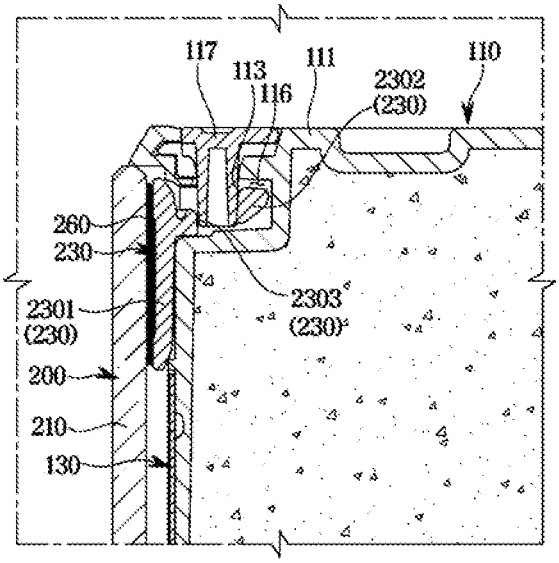
FIG. 5 is a cross-sectional view showing a state in which an upper trim shown in FIG. 3 is coupled to the door body.
Figure 6:
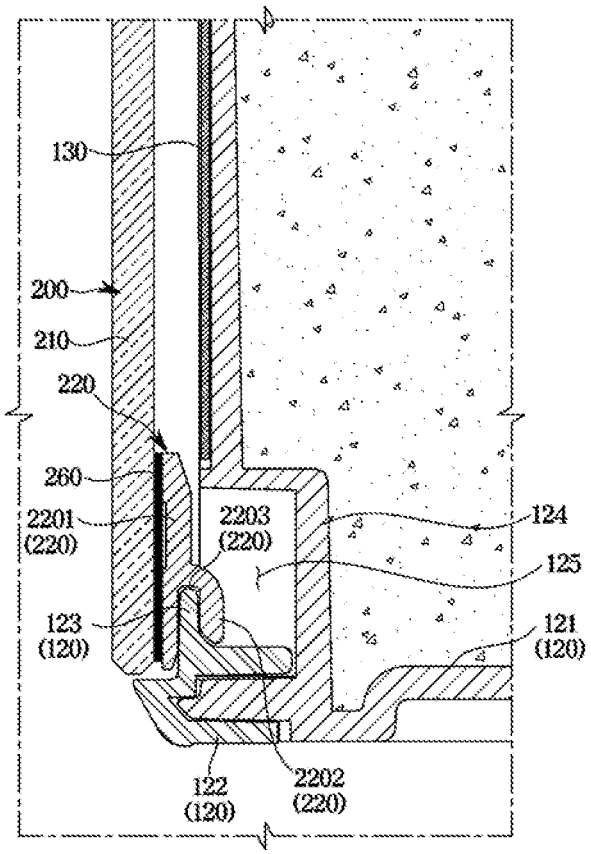
FIG. 6 is a cross-sectional view showing a state in which a lower trim shown in FIG. 3 is coupled to the door body.
Figure 7:
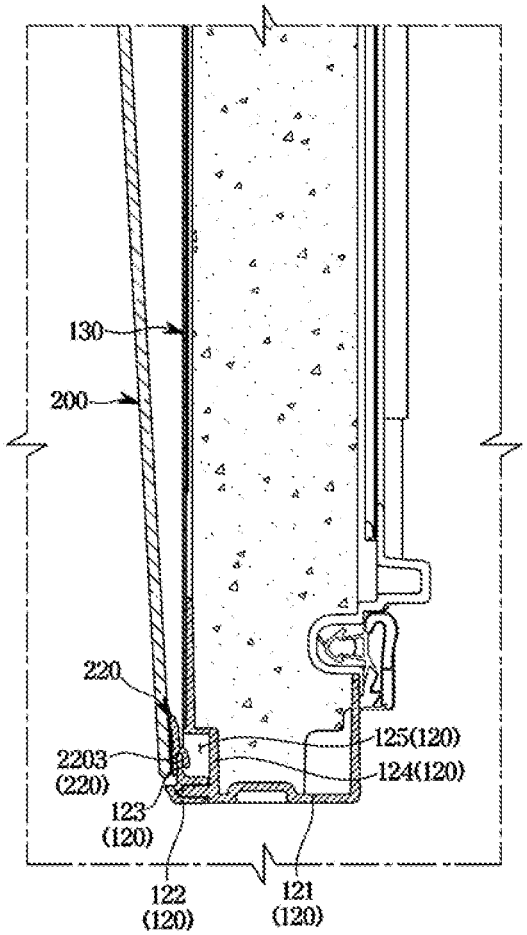
FIG. 7 shows a state in which the door panel shown in FIG. 3 is coupled to the door body.

FIG. 2 is a perspective view of a door shown in FIG. 1. FIG. 3 is an exploded view of a door body, a door panel, and a chassis unit of the door shown in FIG. 2. FIG. 4 is an exploded perspective view of the door body shown in FIG. 3 and shows a chassis unit. FIG. 5 is a cross-sectional view showing a state in which an upper trim shown in FIG. 3 is coupled to the door body. FIG. 6 is a cross-sectional view showing a state in which a lower trim shown in FIG. 3 is coupled to the door body. FIG. 7 shows a state in which the door panel shown in FIG. 3 is coupled to the door body.

Referring to FIGS. 2 and 3, the door 30 may include a door panel 200 and a door body 100. Also, the door 30 may include a chassis unit 300 detachably coupled to the door body 100 at one side of the door 30.

Referring to FIG. 3, the door panel 200 may include a panel body 210, a buffer member 250, and fixing trims 220, 230, and 240. The door panel 200 may be coupled to the door body 100 in such a way as to be detachable from a front surface of the door body 100.

The panel body 210 may form an outer appearance of the door 30. The panel body 210 may be in a shape of a flat plate. Various designs for satisfying a user's need may be provided on a front surface of the panel body 210. On a rear surface of the panel body 210, the fixing trims 220, 230, and 240 for coupling with the door body 100 and the chassis unit 300 may be positioned.

The panel body 210 may have a thickness of a preset size or more. The panel body 210 of the refrigerator 1 according to an embodiment of the disclosure may include glass. In a case in which the panel body 210 has a thickness of a preset size or more, edges of the panel body 210 may be finished to be not sharp.

However, a material of the panel body 210 is not limited to this, and the panel body 210 may include an iron plate.

The buffer member 250 may be positioned on the rear surface of the panel body 210. The buffer member 250 may be positioned in a space formed between the door panel 200 and the door body 100. The buffer member 250 may prevent an impact applied to the door panel 200 from being transferred to the door body 100. Also, the buffer member 250 may absorb noise that may be generated in the door panel 200. The buffer member 250 may include expanded polystyrene.

Referring to FIGS. 3, 5, 6, and 7, the fixing trims may include a lower trim 220, an upper trim 230, and side trims 240.

The fixing trims may be attached to the panel body 210 through an adhesive 260 (see FIG. 5). The fixing trims may be bonded to the panel body 210 by a Poly Urethane Reactive (PUR) adhesion method. However, a method for fixing the fixing trims is not limited to this. The door panel 200 may be firmly coupled to the door body 100 by the fixing trims in such a way as to be easily detachable from the door body 100.

Referring to FIGS. 3 and 4, the door body 100 may include an upper door cap 110, a lower door cap 120, a cover plate 130, and a rear unit 140.

The upper door cap 110 may be coupled to upper ends of a side chassis 170 and the chassis unit 300. The upper door cap 110 may form an upper surface of a first door 30.

The upper door cap 110 may include an upper cap body 111, an upper cap hole 112 formed in the upper cap body 111, and a passage opening 113 formed in an upper side of the upper cap body 111.

The upper cap hole 112 may be formed at a location corresponding to a cover hole 132 of the cover plate 130 which will be described below such that the upper door cap 110 is coupled to the cover plate 130.

The passage opening 113 may communicate an upper coupling groove 116 (see FIG. 5) with outside, without a fixing member installed therein. A fixing member 117 may be inserted in the upper coupling groove 116 through the passage opening 113 and then coupled to an upper trim hole 2303 of the upper trim 230 of the door panel 200.

After the fixing member 117 is completely inserted, the passage opening 113 may be covered through the fixing member 117. The fixing member 117 may be detachably installed in the upper cap body 111.

The upper cap hole 112 may be formed in the upper cap body 111. A coupling member (not shown) for coupling with the cover plate 130 may be coupled to the upper cap hole 112. The cover plate 130 may be arranged with respect to the upper door cap 110 such that the cover hole 132 is positioned at a location corresponding to the upper cap hole 112, and then the coupling member may be inserted into the cover hole 132 and the upper cap hole 112, thereby fixing the cover plate 130 to the upper door cap 110.

The upper door cap 110 may include a cap trim coupling portion 114 to which an upper cap trim 150 which will be described below is coupled. The cap trim coupling portion 114 may be provided at a front portion of an upper surface of the upper door cap 110.

The upper door cap 110 may include an ABS resin (acrylonitrile butadiene styrene copolymer).

The door body 100 may include the upper cap trim 150. The upper cap trim 150 may be coupled to a front portion of the upper door cap 110 to be positioned at an upper edge of the door 30. More specifically, the upper cap trim 150 may form an upper border of the door 30.

The lower door cap 120 may be coupled to lower ends of the side chassis 170 and the chassis unit 300. The lower door cap 120 may form a bottom surface of the door 30. The lower door cap 120 may include a lower cap body 121 and a lower cap trim 122 coupled to the lower cap body 121.

The lower cap trim 122 may be coupled to a front portion of the lower cap body 121 to be positioned at a lower edge of the door 30. More specifically, the lower cap trim 122 may form a lower border of the door 30.

The lower door cap 120 may include an ABS resin (acrylonitrile butadiene styrene copolymer).

The cover plate 130 may be positioned behind the door panel 200 to form a front surface and one side surface of the door body 100. A trim installing chassis 310 of the chassis unit 300 may be coupled to one side of the cover plate 130.

The cover plate 130 may include a cover body 131.

The cover body 131 may include a cover hole 132 through which a coupling member passes upon coupling of the cover plate 130 to the side chassis 170, the upper door cap 110, and the lower door cap 120. While coupling members pass through cover holes 132 and then are respectively coupled to the side chassis 170, the upper door cap 110, and the lower door cap 120, some portions of borders of the cover body 131 may be respectively fixed to the side chassis 170, the upper door cap 110, and the lower door cap 120.

One side of the cover plate 130 may form one side surface of the door body 100. More specifically, the cover plate 130 may include a chassis resting portion 135 and a chassis coupling portion 136.

The chassis resting portion 135 may be stepped from the cover body 131 such that a cover resting portion 311 of the trim installing chassis 310 which will be described below is rested on the chassis resting portion 135.

The chassis coupling portion 136 may be stepped from the chassis resting portion 135 such that a cover coupling portion 312 of the trim installing chassis 310 is rested on the chassis coupling portion 136. The trim installing chassis 310 may be coupled to the chassis coupling portion 136.

In the chassis coupling portion 136, a chassis coupling hole 1361 for coupling with the trim installing chassis 310 may be formed.

The cover plate 130 may include an extension portion 137 and a frame support portion 138.

The extension portion 137 may extend in a rear direction from the chassis coupling portion 136 to form one side surface of the door body 100.

The frame support portion 138 may extend from the extension portion 137 toward an inner portion of the cover plate 130. The frame support portion 138 may be in contact with a rear frame 141 of the rear unit 140 which will be described below.

Also, in the other side of the cover plate 130, a bending portion 134 bent inward from the cover body 131 may be formed. The bending portion 134 may be bent toward the side chassis 170.

Accordingly, one side of the cover plate 130 may be coupled to the rear unit 140 to form one side surface of the door body 100. Also, the other side of the cover plate 130 may be coupled to the side chassis 170.

The rear unit 140 may include the rear frame 141 and a rear plate 143.

The rear frame 141 may be substantially in a shape of a quadrangular ring. The rear plate 143 may be coupled to the rear frame 141 to cover an open rear surface of the rear frame 141.

The rear unit 140 may be positioned behind the cover plate 130 to form a rear surface of the door body 100.

The door body 100 may include the side chassis 170.

The side chassis 170 may include a first fixing hole 1711 and a second fixing hole 1751.

The first fixing hole 1711 may be formed at a location corresponding to the cover hole 132 formed in the cover body 131 of the cover plate 130. More specifically, the first fixing hole 1711 may be formed in a cover support portion 171 which will be described below. By coupling a separate coupling member to the first fixing hole 1711 and the cover hole 132, the side chassis 170 may be coupled to the cover plate 130.

The second fixing hole 1751 may be provided to couple the rear frame 141 to the cover plate 130. More specifically, the second fixing hole 1751 may be formed in a frame coupling portion 175 which will be described below.

Accordingly, the cover plate 130 may be bent in one side of the door body 100, and the side chassis 170 may be provided in the other side of the door body 100 to form both side surfaces of the door body 100. Also, the chassis unit 300 may be coupled to one side of the cover plate 130.

More specifically, the side chassis 170 may form a left side surface of the door 30 together with a left side surface of the door body 100 with respect to a front direction. The chassis unit 300 may form a right side surface of the door 30 with respect to the front direction.

That is, the side chassis 170, the upper door cap 110, the lower door cap 120, and the cover plate 130 may form upper, lower, left, and right surfaces of the door 30 and one side surface of the door 30. Also, the rear unit 140 may form the rear surface of the door 30. Meanwhile, FIG. 4 shows a case in which the side chassis 170, the upper door cap 110, and the lower door cap 120 are detachably provided. However, the side chassis 170, the upper door cap 110, and the lower door cap 120 may be integrated into one body.

Referring to FIGS. 3 and 5, the upper trim 230 may include an upper trim body 2301, an upper trim protrusion 2302, and the upper trim hole 2303. The upper trim 230 may be positioned at an upper border portion of the panel body 210.

The upper trim body 2301 may extend substantially horizontally to be fixed to an upper end portion of the panel body 210. The upper trim body 2301 may be substantially in a shape of a rectangular plate. The upper trim body 2301 may be fixed to the panel body 210 through an adhesive 260.

The upper trim protrusion 2302 may protrude in the rear direction from the upper trim body 2301. The upper trim protrusion 2302 may be insertable in the upper coupling hole 2303 of the upper door cap 110. The upper trim protrusion 2302 may be fixed in a state of being inserted in the upper coupling hole 2303 by a fixing member 117.

The upper trim hole 2303 may be formed in the upper trim protrusion 2302. The fixing member 117 may be inserted in the upper trim hole 2303. The upper trim hole 2303 may penetrate the upper trim protrusion 2302 substantially vertically. By inserting the fixing member 117 into the upper trim hole 2303 in a state of inserting the upper trim protrusion 2302 into the upper coupling hole 2303, an upper end of the panel body 210 may be fixed to the door body 100.

Referring to FIGS. 3 and 6, the lower trim 220 may include a lower trim body 2201, a lower trim protrusion 2202, and a lower trim groove 2203. The lower trim 220 may be positioned at a lower border portion of the panel body 210.

The lower trim body 2201 may extend substantially horizontally to be fixed to a lower end portion of the panel body 210. The lower trim body 2201 may be substantially in a shape of a rectangular plate. The lower trim body 2201 may be fixed to the panel body 210 through an adhesive 260.

The lower trim protrusion 2202 may protrude in the rear direction from the lower trim body 2201. The lower trim protrusion 2202 may form a lower trim groove 2203 between the lower trim protrusion 2202 and the lower trim body 2201. The lower trim protrusion 2202 may have a shape extending from the lower trim body 2201 in the rear direction by a preset length and then extending substantially in an up-down direction.

The lower trim groove 2203 may be formed between the lower trim protrusion 2202 and the lower trim body 2201. The lower trim groove 2203 may accommodate a lower cap protrusion 123 of the lower cap trim 122. The lower trim groove 2203 may correspond to a size and/or shape of the lower cap protrusion 123. By inserting the lower cap protrusion 123 into the lower trim groove 2203, a lower end of the panel body 210 may be fixed to the door body 100.

Referring to FIG. 7, the door panel 200 may be arranged such that the lower trim 220 is toward the lower cap protrusion 123 of the door body 100. The door panel 200 may extend upward from the lower cap protrusion 123 toward the front direction. The door panel 200 may rotate such that the lower cap protrusion 123 is inserted in the lower trim groove 2203 in a state in which an end portion of the lower cap protrusion 123 is arranged to be positioned at an entrance of the lower trim groove 2203.

The door panel 200 may rotate in a clockwise direction in FIG. 7 to be primarily coupled to the door body 100. Because an installing space 125 is formed in the lower door cap 120, the door panel 200 may be coupled to the door body 100 by rotating with respect to the door body 100.

Hereinafter, the side trims 240 may be coupled to a first panel fixing portion 1721 of the side chassis 170 and a second panel fixing portion 3121 of the trim installing chassis 310 and fixed such that the door panel 200 is aligned with the door body 100, which will be described below. Hereinafter, as shown in FIG. 5, the upper trim 230 may be fixed inside an upper coupling groove 116 of the upper door cap 110.

Figure 8:
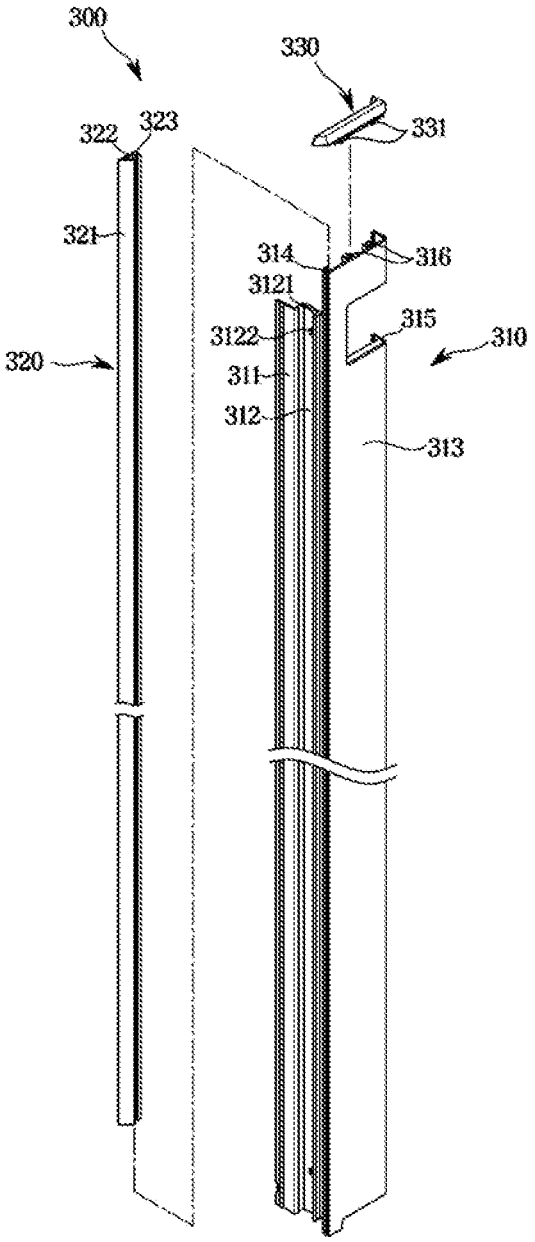
FIG. 8 is an exploded view of the chassis unit shown in FIG. 4.
Figure 9:
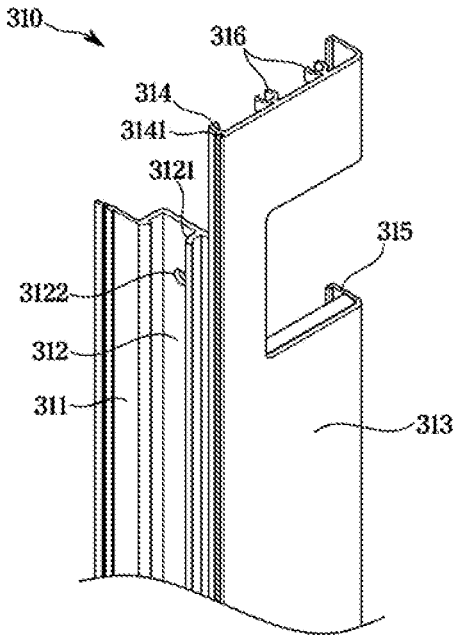
FIG. 9 is an enlarged view of an upper portion of a trim installing chassis shown in FIG. 8.
Figure 10:
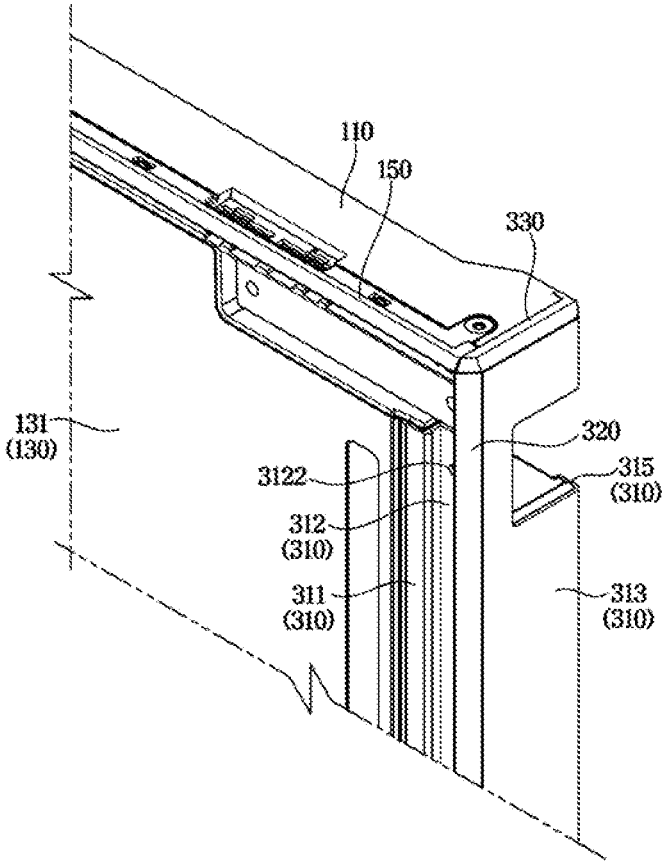
FIG. 10 is a top enlarged view showing a state in which the chassis unit shown in FIG. 4 is coupled to the door body.

FIG. 8 is an exploded view of the chassis unit shown in FIG. 4. FIG. 9 is an enlarged view of an upper portion of a trim installing chassis shown in FIG. 8. FIG. 10 is a top enlarged view showing a state in which the chassis unit shown in FIG. 4 is coupled to the door body.

As shown in FIGS. 8 to 10, the chassis unit 300 may include the trim installing chassis 310, a deco trim 320, and a sub trim 330.

The trim installing chassis 310 may include the cover resting portion 311. The cover resting portion 311 may correspond to a shape of the chassis resting portion 135 of the cover plate 130.

The trim installing chassis 310 may include the cover coupling portion 312 stepped inward from the cover resting portion 311. The cover coupling portion 312 may correspond to a shape of the chassis coupling portion 136 of the cover plate 130. The cover coupling portion 312 may be coupled to the chassis coupling portion 136 of the cover plate 130.

More specifically, a cover coupling hole 3122 may be provided in the cover coupling portion 312 to communicate with the chassis coupling hole 1361 of the chassis coupling portion 136. Accordingly, the trim installing chassis 310 may be coupled to the cover plate 130.

Also, the second panel fixing portion 3121 may be formed in the cover coupling portion 312. Each side trim 240 of the door panel 200 which will be described below may be fixed to the second panel fixing portion 3121. The second panel fixing portion 3121 of the trim installing chassis 310 may be in a shape of a rib extending in the front direction from the cover coupling portion 312. The second panel fixing portion 3121 may have a shape that is substantially symmetrical to the first panel fixing portion 1721 of the side chassis 170.

The trim installing chassis 310 may include a second side portion 313 forming one side surface of the door 30.

The trim installing chassis 310 may include a trim coupling portion 314. The trim coupling portion 314 may be formed at a front end of the second side portion 313.

The trim coupling portion 314 may include a protrusion inserting groove 3141 in which a guide protrusion 322 (see FIG. 15) of the deco trim 320 is inserted such that the deco trim 320 is slidingly coupled to the trim installing chassis 310.

The protrusion inserting groove 3141 may be formed by being depressed toward an inner portion of the trim coupling portion 314.

The trim installing chassis 310 may include a chassis fixing portion 315. The chassis fixing portion 315 may be formed at a rear end of the second side portion 313.

More specifically, the chassis fixing portion 315 may be bent inward from the second side portion 313. An end of the chassis fixing portion 315 may be inserted in a second supporting groove 1411 (see FIG. 11) of the rear frame 141 which will be described below.

The trim installing chassis 310 may include an extension rib 316 extending inward from the second side portion 313. More specifically, the extension rib 316 may be provided in a space formed in inner portions of the trim coupling portion 314, the second side portion 313, and the chassis fixing portion 315 of the trim installing chassis 310.

The sub trim 330 which will be described below may be coupled to the extension rib 316. Also, an inward extension length of the extension rib 316 may be substantially similar to a width of the deco trim 320. The extension rib 316 may be provided in a space between the trim installing chassis 310 and the cover plate 130 to reinforce stiffness of the trim installing chassis 310.

Details about a coupling relationship between the trim installing chassis 310 and the cover plate 130 will be described below.

The deco trim 320 may extend along a direction of a rotation axis on which the door 30 rotates. Accordingly, the deco trim 320 may form a side edge of the door panel 200.

The deco trim 320 may include a deco portion 321, a guide protrusion 322, and a slide portion 323.

The deco portion 321 of the deco trim 320 may be substantially inclined with respect to a front surface of the door 30. The deco portion 321 may be positioned between the door panel 200 and the trim installing chassis 310 to form a border of the door 30.

The deco trim 320 may include a guide protrusion 322 extending in the rear direction from the deco portion 321. More specifically, the guide protrusion 322 may extend toward the trim coupling portion 314 of the trim installing chassis 310 and be inserted in the protrusion inserting groove 3141 of the trim installing chassis 310.

The deco trim 320 may include the slide portion 323 bent to an inner portion of the trim coupling portion 314 of the trim installing chassis 310. Accordingly, the deco trim 320 may be slidingly coupled to the trim coupling portion of the trim installing chassis 310. A detailed assembly method related to this will be described below.

The sub trim 330 may cover open upper portions of the deco trim 320 and the trim installing chassis 310. The sub trim 330 may be installed at a corner of the door 30. The sub trim 330 may include a chassis coupling protrusion 331 extending downward to be coupled to the trim installing chassis 310.

Accordingly, as shown in FIG. 10, the sub trim 330 may form a corner portion of the door 30. Also, the sub trim 330 may form an edge of the door 30 together with the upper cap trim 150 and the deco trim 320.

Figure 11:
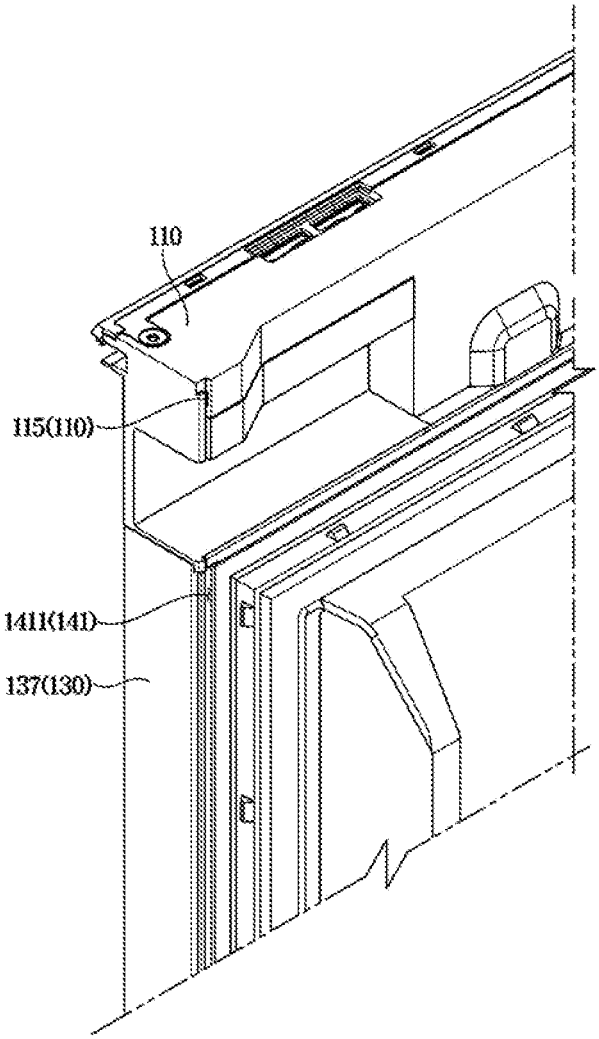
FIG. 11 is an enlarged view showing an upper portion of the door body shown in FIG. 3 from behind.
Figure 12:
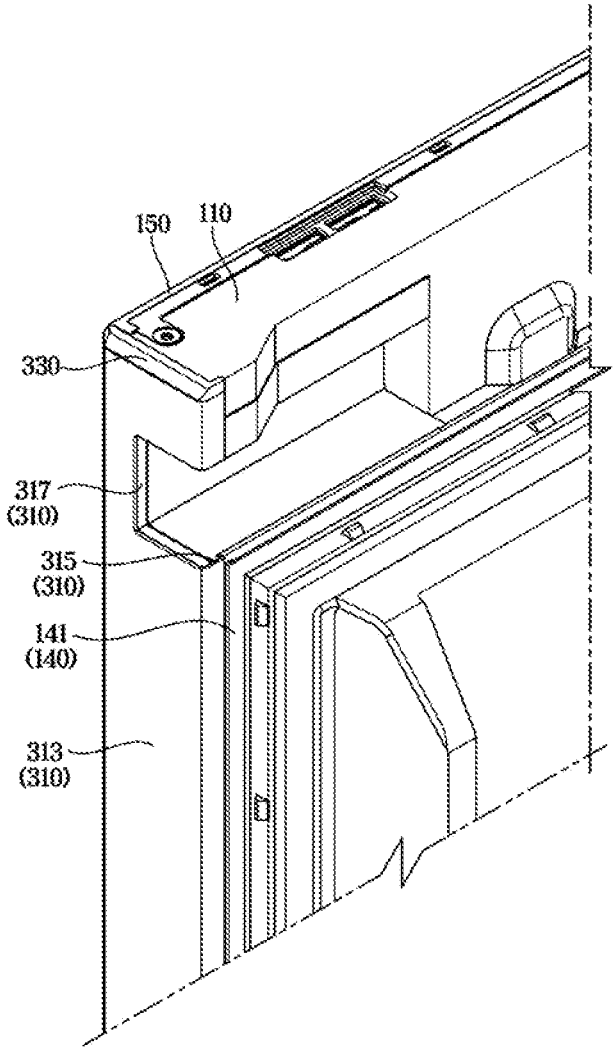
FIG. 12 is an enlarged view showing a state in which the chassis unit shown in FIG. 4 is coupled to the door body shown in FIG. 11 from behind.

FIG. 11 is an enlarged view showing an upper portion of the door body shown in FIG. 3 from behind. FIG. 12 is an enlarged view showing a state in which the chassis unit shown in FIG. 4 is coupled to the door body shown in FIG. 11 from behind.

As shown in FIG. 11, the upper door cap 110 may include a first support groove 115. Also, the rear frame 141 may include a second support groove 1411.

The first support groove 115 and the second support groove 1411 may be depressed in the up-down direction from one side of the door body 100. More specifically, the first support groove 115 may be depressed from a rear portion of the upper door cap 110. The second support groove 1411 may be depressed from a rear portion of the rear frame 141.

As shown in FIG. 12, upon coupling of the chassis unit 300 to the door body 100, the chassis fixing portion 315 of the trim installing chassis 310 may be inserted in the first support groove 115 and the second support groove 1411.

Accordingly, the chassis unit 300 may be primarily fixed to the door body 100. In other words, relative positions of the trim installing chassis 310 of the chassis unit 300 and the door body 100 may be fixed. Then, a separate coupling member may be coupled to the cover coupling hole 3122 formed in the trim installing chassis 310 of the chassis unit 300 and the chassis coupling hole 1361 of the cover plate 130 to completely couple the chassis unit 300 to the door body 100.

Figure 13:
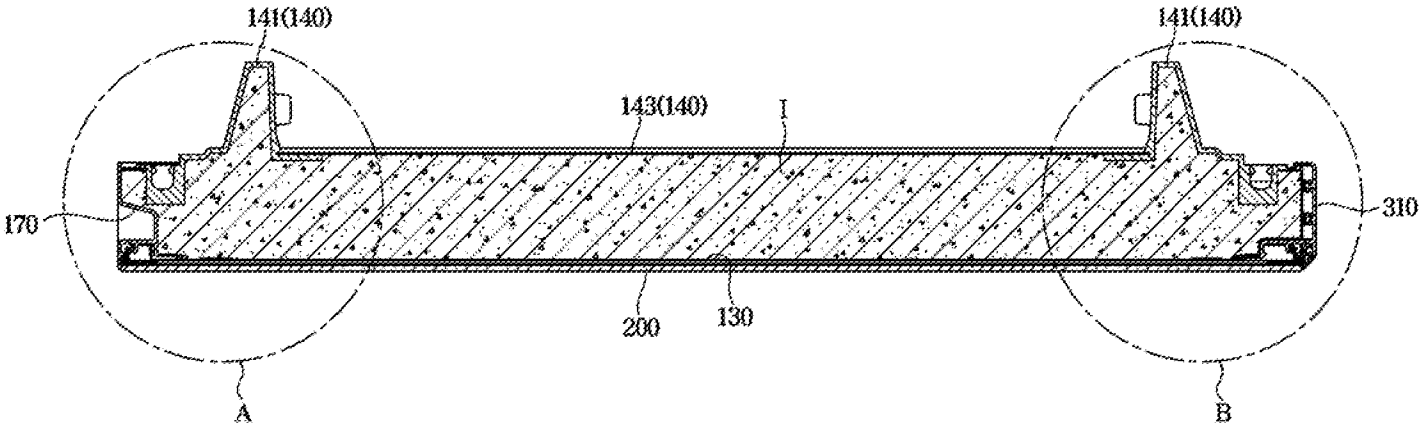
FIG. 13 is a cross-sectional view of the door shown in FIG. 2.
Figure 14:
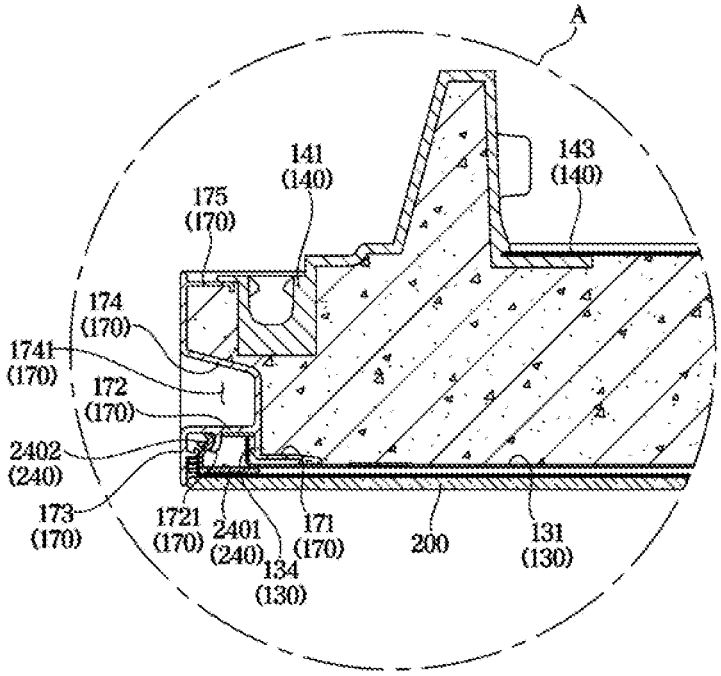
FIG. 14 is an enlarged view showing an A area of FIG. 13.
Figure 15:
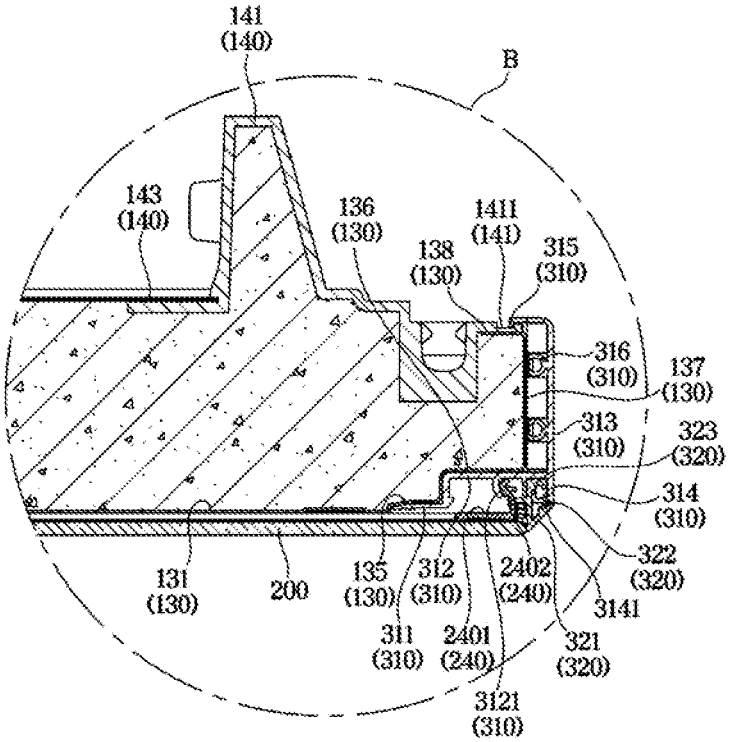
FIG. 15 is an enlarged view showing a B area of FIG. 13.

FIG. 13 is a cross-sectional view of the door shown in FIG. 2. FIG. 14 is an enlarged view showing an A area of FIG. 13. FIG. 15 is an enlarged view showing a B area of FIG. 13.

As shown in FIG. 13, the trim installing chassis 310 may be installed in one side of the door 30 to form one side surface of the door 30. Also, the side chassis 170 may be installed in the other side of the door 30 to form the other side surface of the door 30.

Referring to FIG. 14, the side chassis 170 may include a cover support portion 171 and a step portion 172.

The cover support portion 171 may support a rear surface of the cover body 131 of the cover plate 130. The cover support portion 171 may extend in a direction that is substantially parallel to a front surface of the cover plate 130.

The step portion 172 may extend inward from the cover support portion 171 in such a way as to be stepped from the cover support portion 171. A first panel fixing portion 1721 may extend in a front direction from a front surface of the step portion 172 of the side chassis 170. The side trim 240 of the door panel 200 may be supported by the first panel fixing portion 1721.

Also, the bending portion 134 of the cover plate 130 may be bent between the cover support portion 171 and the step portion 172.

The side chassis 170 may include a first side portion 173. The first side portion 173 of the side chassis 170 may form the other side surface of the door body 100 between the rear unit 140 and the cover plate 130. More specifically, the first side portion 173 of the side chassis 170 may form the other side surface of the door 30.

The side chassis 170 may include a handle portion 174 depressed to inside of the door 30 from the first side portion 173. A grip space 1741 capable of accommodating a user's fingers may be formed inside the handle portion 174.

The side chassis 170 may include a frame coupling portion 175. The frame coupling portion 175 may extend from the first side portion 173 to be in contact with the rear frame 141.

Accordingly, an insulation I may be foamed in inner portions of the side chassis 170, the rear frame 141, the rear plate 143, and the cover plate 130.

Thereby, the door body 100 including the insulation I may be formed.

The door panel 200 may be detachably coupled to a front portion of the door body 100. More specifically, the side trim 240 may be provided on a rear surface of the door panel 200. The side trim 240 may include a side trim body 2401 and a side trim protrusion 2402 extending from the side trim body 2401 toward the side chassis 170.

The first panel fixing portion 1721 of the side chassis 170 may include a material having certain elasticity such that the first panel fixing portion 1721 is, upon coupling to the side trim protrusion 2402 of the side trim 240, pressed by the side trim protrusion 2402, deformed, and restored.

The first panel fixing portion 1721 may generate, upon coupling of the side trim 240 to the door body 100, an elastic force in a direction of being in contact with the side trim 240. At least one portion of the first panel fixing portion 1721 may be bent toward the side trim 240.

Referring to FIG. 15, the trim installing chassis 310 may be detachably installed in the door body 100 to form one side surface of the door 30.

The trim installing chassis 310 may include the cover resting portion 311 and the cover coupling portion 312.

The cover resting portion 311 may be in contact with the chassis resting portion 135 of the cover plate 130. More specifically, the cover resting portion 311 may have a shape corresponding to the chassis resting portion 135.

The cover coupling portion 312 may be stepped from the cover resting portion 311 toward inside of the trim installing chassis 310. A second panel fixing portion 3121 may extend on a front surface of the cover coupling portion 312 toward the door panel 200.

The second panel fixing portion 3121 may extend in the front direction from the cover coupling portion 312 to be in contact with the side trim 240. The second panel fixing portion 3121 may fix a location of the door panel 200 with respect to the door body 100.

The trim installing chassis 310 may include a second side portion 313. The second side portion 313 may form one side surface of the door 30. The second side portion 313 may extend to be substantially parallel to the extension portion 137 of the cover plate 130.

Accordingly, the second side portion 313 may extend from the trim coupling portion 314 to be parallel to the extension portion 137 of the cover plate 130 and form one side surface of the door 30.

The chassis fixing portion 315 of the trim installing chassis 310 may be bent inward from a rear portion of the second side portion 313 and inserted in the second support groove 1411 of the rear frame 141.

The trim installing chassis 310 may include the trim coupling portion 314. The trim coupling portion 314 may be formed in a front portion of the second side portion 313 and the deco trim 320 may be coupled to the trim coupling portion 314.

The trim coupling portion of the trim installing portion 310 may protrude in a side direction of the door body 100 and the door panel 200.

More specifically, a side portion of the door panel 200 and the extension portion 137 of the cover plate 130 may be on the same line. However, upon coupling of the trim installing chassis 310 to the cover plate 130, the trim coupling portion 314 may be positioned in a side direction of the door panel 200. That is, the trim coupling portion 314 may extend outward from the cover coupling portion 312 and protrude in the side direction from the extension portion 137 of the cover plate 130. Thereby, a space in which the deco trim 320 may be installed may be provided.

The deco trim 320 may be installed in a front portion of the trim coupling portion 314. The deco trim 320 may cover the front portion of the trim coupling portion 314.

More specifically, the guide protrusion 322 of the deco trim 320 may be inserted in the protrusion inserting groove 3141 of the trim coupling portion 314. Also, the slide portion 323 of the deco trim 320 may be bent to an inner portion of the trim coupling portion 314 of the trim installing chassis 310.

Accordingly, the deco trim 320 may be slidingly coupled to the trim installing chassis 310. Details about a process for assembling the deco trim 320 will be described below.

Accordingly, the deco trim 320 may be installed in the trim installing chassis 310. The deco trim 320 may cover the front portion of the trim coupling portion 314 of the trim installing chassis 310 to form an edge of the door panel 200. Accordingly, a user who sees the door 30 of the refrigerator 1 according to an embodiment of the disclosure in the front direction may recognize that the deco trim 320 forms a side edge of the door 30.

Referring to FIGS. 2, 14, and 15, the side trims 240 may extend substantially vertically to be fixed respectively to a left side end portion and a right side end portion of the panel body 210.

FIGS. 16 to 21 show a process for assembling a chassis unit and a door panel with a door body of a refrigerator according to an embodiment of the disclosure.

Figure 16:
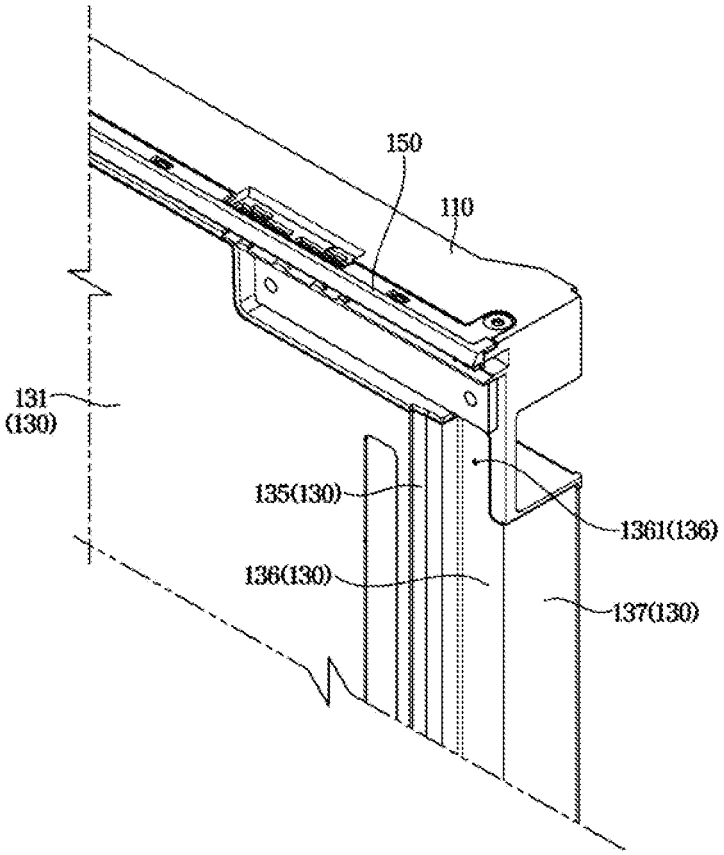
FIGS. 16 to 21 show a process for assembling a chassis unit and a door panel with a door body of a refrigerator according to an embodiment of the disclosure.

FIG. 16 shows the door body 100 in which the insulation I is foamed. At one side of the door body 100, the cover plate 130 may be bent to form one side surface of the door body 100.

Figure 17:
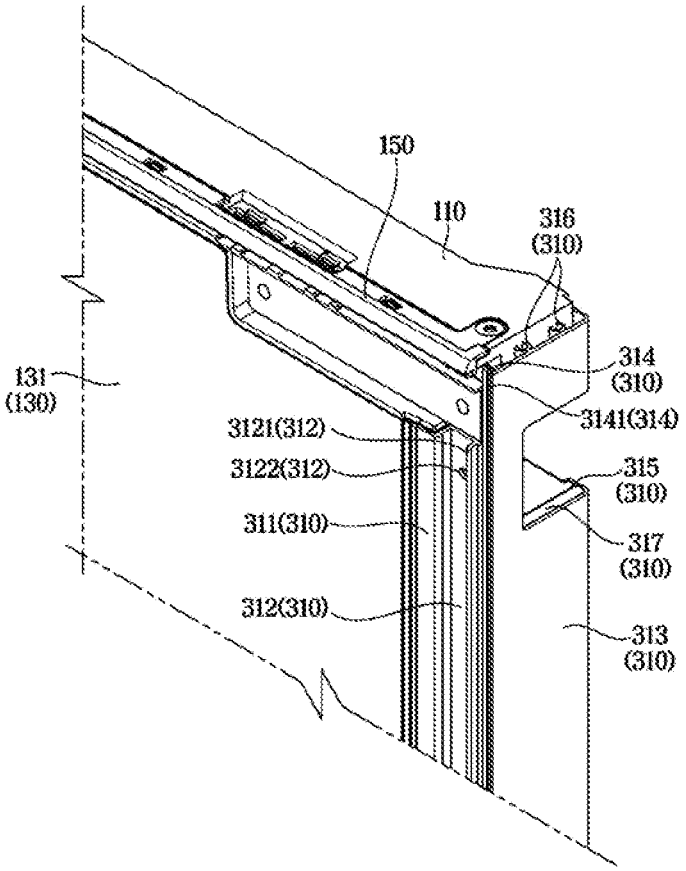

Referring to FIGS. 16 and 17, the trim installing chassis 310 may be coupled to the cover plate 130 to cover the chassis resting portion 135, the chassis coupling portion 136, and the extension portion 137 of the cover plate 130. At this time, by inserting the chassis fixing portion 315 in the first support groove 115 formed in the rear portion of the upper door cap 110 and the second support groove 1411 formed in the rear portion of the rear frame 141 and rotating the chassis fixing portion 315, the trim installing chassis 310 may cover the chassis resting portion 135, the chassis coupling portion 136, and the extension portion 137 of the cover plate 130.

Thereafter, by causing a separate coupling member to penetrate the cover coupling hole 3122 of the cover plate 130 and the chassis coupling hole 1361 of the trim installing chassis 310, the cover plate 130 may be completely coupled to the trim installing chassis 310.

Figure 18:
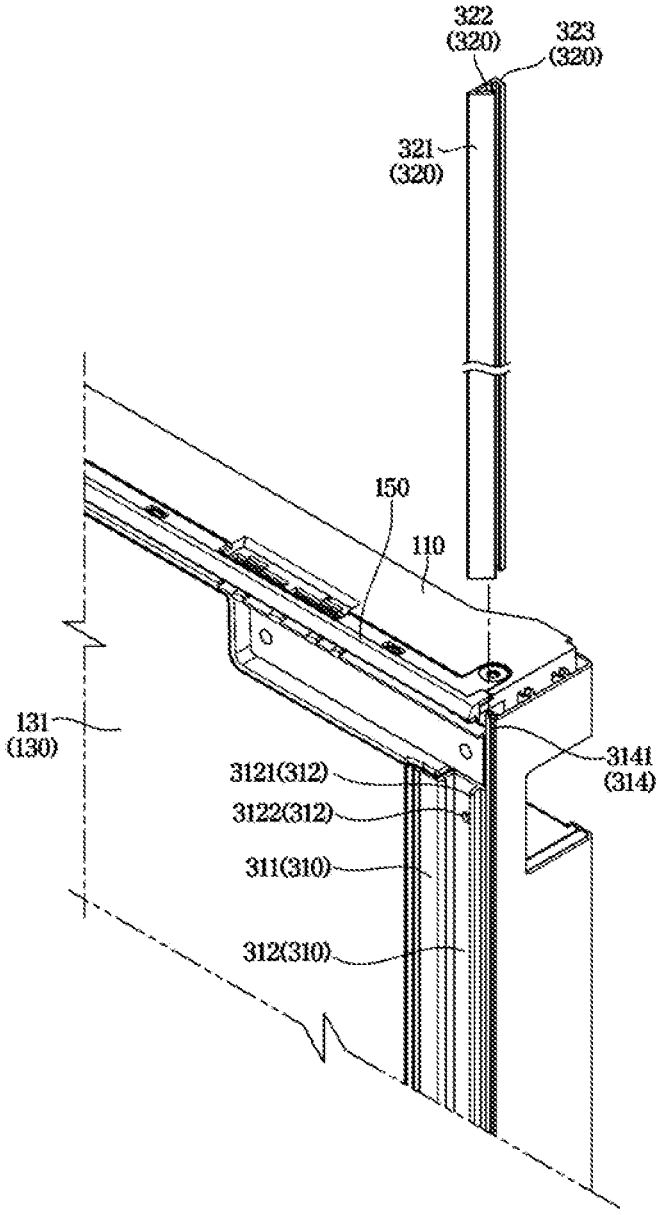

Referring to FIGS. 17 and 18, the deco trim 320 may be slidingly installed in the trim coupling portion 314 of the trim installing chassis 310. The guide protrusion 322 of the deco trim 320 may be inserted in the protrusion inserting groove 3141 of the trim coupling portion 314. Also, in a state in which the slide portion 323 of the deco trim 320 is caught by an inner portion of the trim coupling portion 314 such that a relative position of the deco trim 320 is fixed, the deco trim 320 may be coupled to the trim installing chassis 310.

Figure 19:
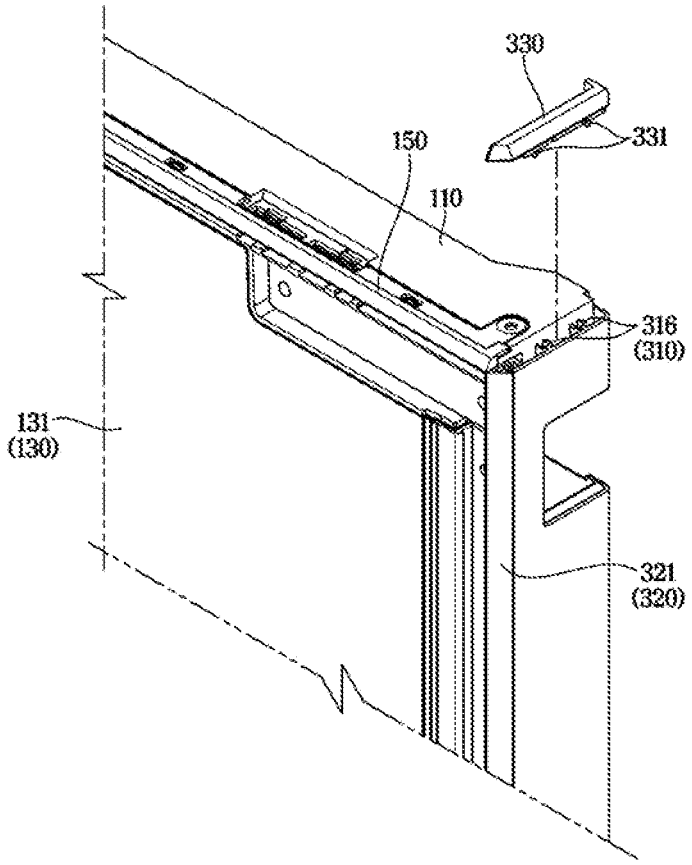

Referring to FIGS. 18 and 19, the sub trim 330 may be coupled to the deco trim 320 and the trim installing chassis 310 to cover the open upper portions of the deco trim 320 and the trim installing chassis 310. More specifically, the chassis coupling protrusion 331 of the sub trim 330 may be inserted in the extension rib 316 of the trim installing chassis 310.

Figure 20:
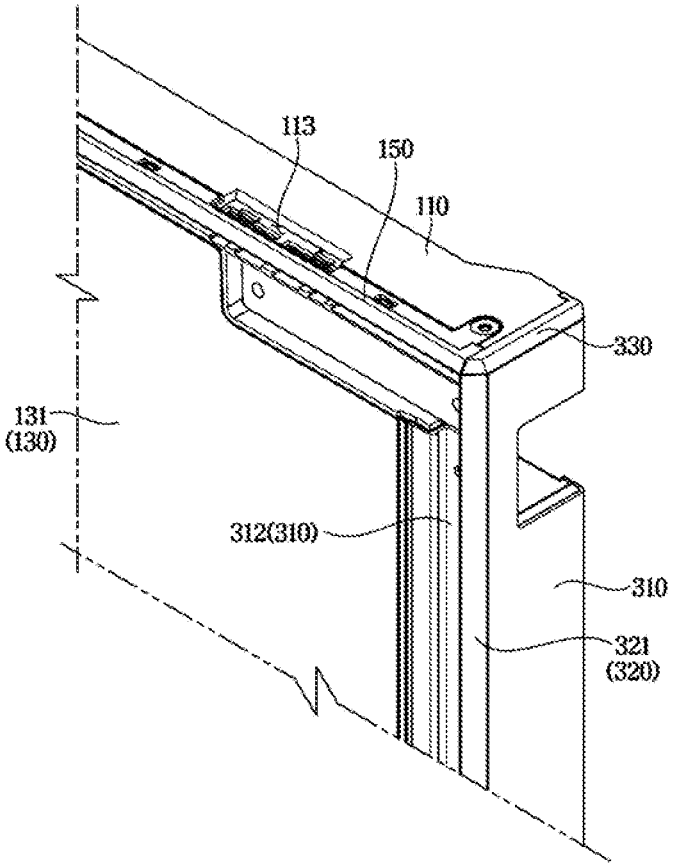

Referring to FIG. 20, after the sub trim 330 is installed, the chassis unit 300 may be completely coupled to the door body 100.

Figure 21:
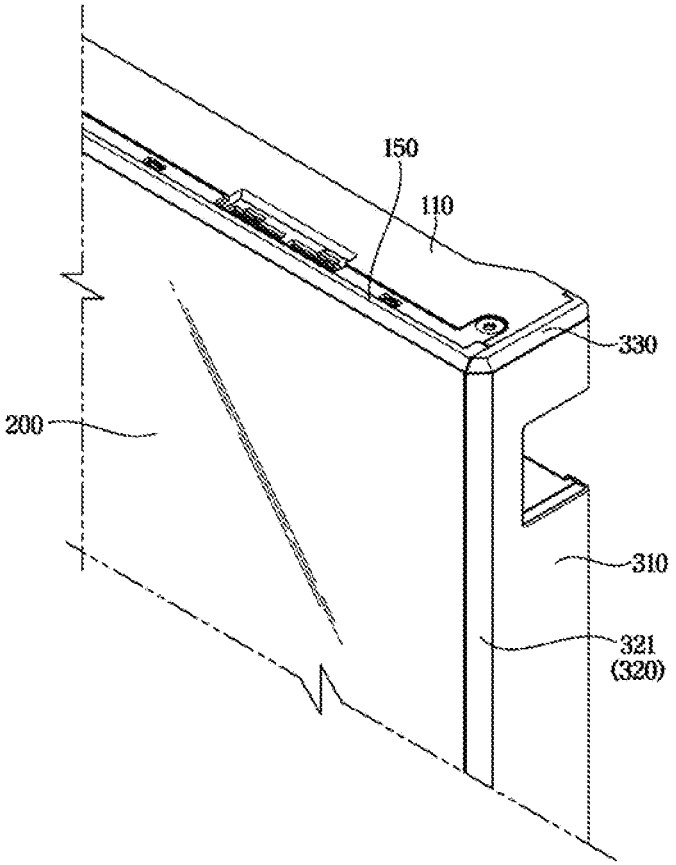

Thereafter, referring to FIG. 21, the door panel 200 may be coupled to a front portion of the door body 100. A method for coupling the door panel 200 may be a method of rotating the door panel 200 and coupling the door panel 200 such that the lower trim groove 2203 formed in the lower trim 220 of the door panel 200 accommodates the lower cap protrusion 123 formed in the lower door cap 120 of the door body 100, as described above. Thereafter, the side trim 240 of the door panel 200 may be fixed to the first panel fixing portion 1721 and the second panel fixing portion 3121. At this time, the first panel fixing portion 1721 and the second panel fixing portion 3121 may elastically support the side trim 240.

Thereafter, by inserting the upper trim 230 of the door panel 200 in the upper coupling groove 116 of the upper door cap 110 and causing the fixing member 117 to penetrate the passage opening 113 of the upper door cap 110 to couple the upper door cap 110 to the door panel 200, the door panel 200 may be completely fixed.

As shown in FIG. 21, by coupling the deco trim 320 to the sub trim 330, the corners and side edge of the door 30 may be covered.

In the refrigerator 1 according to an embodiment of the disclosure, because the chassis unit 300 in which the deco trim 320 is installed is detachably provided on an outer portion of the door body 100 foamed, the deco trim 320 may be selectively installed.

Accordingly, the deco trim 320 may be attached only to an edge of the door 30 of an outermost refrigerator 1 upon arrangement of a plurality of refrigerators 1. Accordingly, the plurality of refrigerators 1 arranged may have a sense of unity, like a single refrigerator 1. That is, a whole esthetic sense of the refrigerators 1 may be improved.

Figure 22:
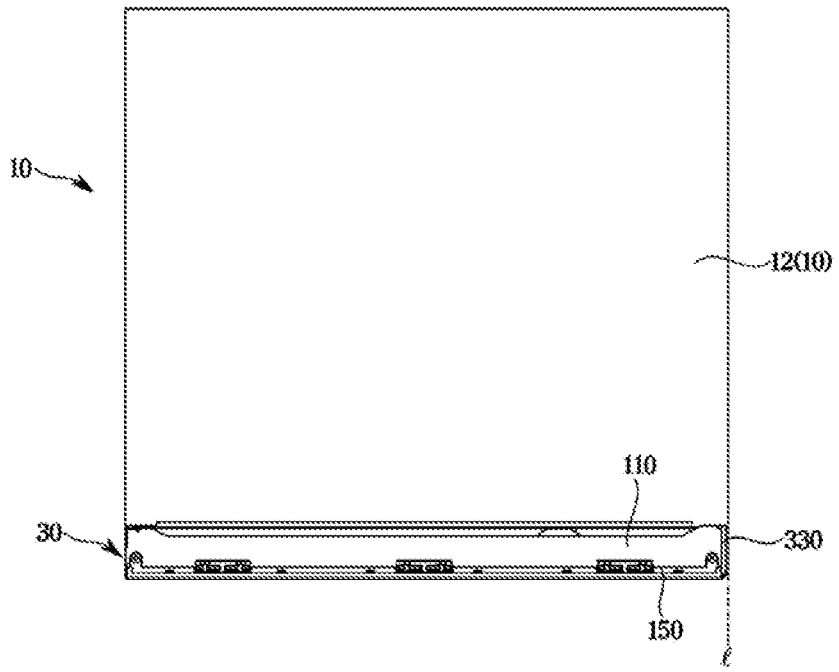
FIG. 22 shows an upper surface of the refrigerator of FIG. 1.

FIG. 22 shows an upper surface of the refrigerator of FIG. 1.

The side surface of the door 30 of the refrigerator 1 according to an embodiment of the disclosure and a side surface of the outer case 12 of the main body 10 may be on the same extension line I. The side surface of the door 30 may be the same as a side surface of the sub trim 330.

Accordingly, upon positioning of the refrigerator 1 inside a closet, there may be no empty space between the door 30 and an inner surface of the closet. Accordingly, the door 30 may be fully filled inside the closet, which improves an esthetic sense.

Also, to implement this structure, the door 30 may be connected to the main body 10 through a multi-joint hinge.

A case in which the handle portion 174 is formed in the side chassis 170 in the refrigerator 1 according to an embodiment of the disclosure has been described, although not limited thereto. However, the side chassis 170 may not include the handle portion 174. In this case, a separate handle that may be gripped by a user may be installed in the door 30.

Figure 23:
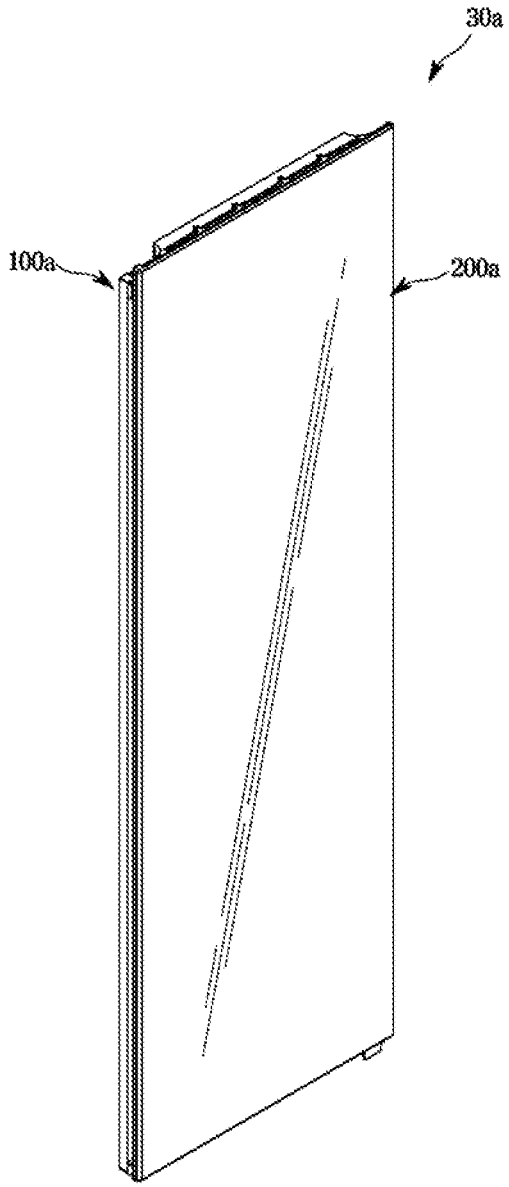
FIG. 23 is a perspective view of a door of a refrigerator according to another embodiment of the disclosure.
Figure 24:
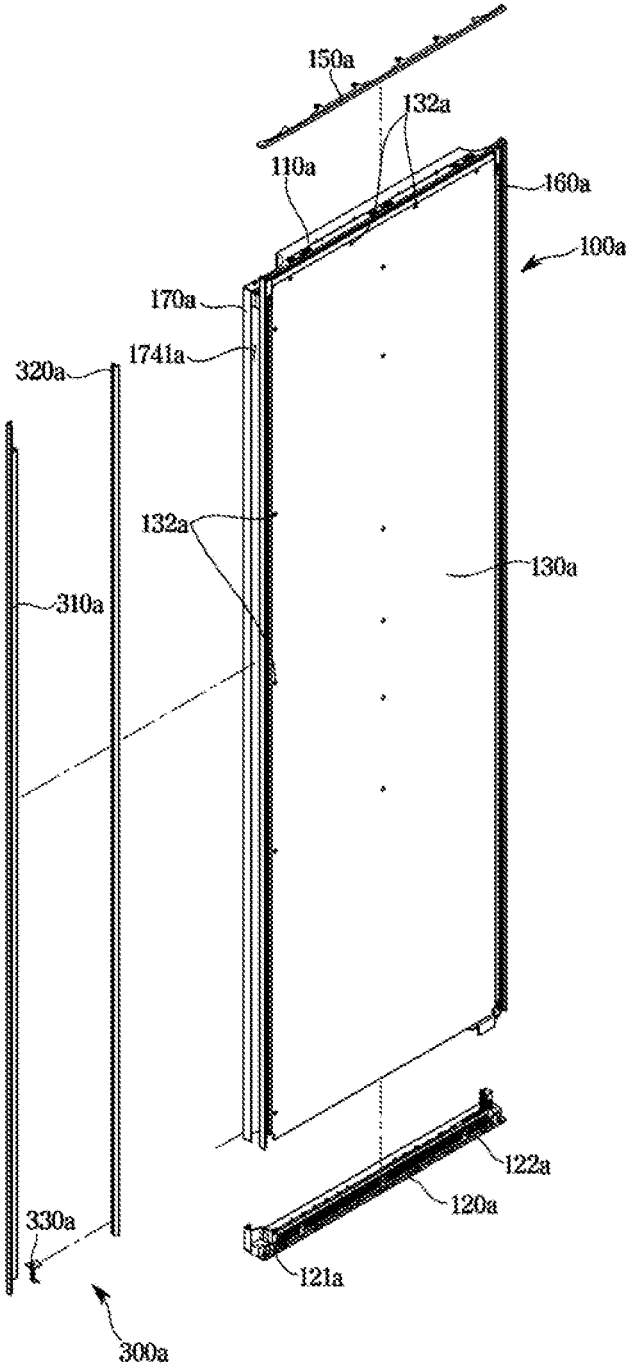
FIG. 24 is an exploded view of the door shown in FIG. 23.

FIG. 23 is a perspective view of a door of a refrigerator according to another embodiment of the disclosure. FIG. 24 is an exploded view of the door shown in FIG. 23.

Hereinafter, only differences from the door 30 according to an embodiment of the disclosure will be described. In a door 30*a* of a refrigerator according to another embodiment of the disclosure, the same components as those of the door 30 of the refrigerator according to an embodiment of the disclosure will be assigned like reference numerals unless otherwise noted.

Referring to FIGS. 23 and 24, the door 30*a* according to another embodiment of the disclosure may include a door body 100*a* including a lower door cap 120*a*, a chassis unit 300*a*, and an upper cap trim 150*a*.

The door body 100*a* may include an upper door cap 110*a* forming an upper surface of the door 30*a*, and a first side chassis 170*a* and a second side chassis 160*a* installed at both side portions of the upper door cap 110*a*.

The door body 100*a* may include the first side chassis 170*a*, the second side chassis 160*a*, and a cover plate 130*a* coupled to a front portion of the upper door cap 110*a*. Also, a rear unit may be the same as the rear unit 140 of the refrigerator according to an embodiment of the disclosure.

Unlike the door body 100 of the refrigerator according to an embodiment of the disclosure, the door body 100*a* of the refrigerator according to another embodiment of the disclosure may have a shape that is symmetrical with respect to a center. Accordingly, a reversible door 30*a* capable of being installed by changing a rotation direction according to a user's needs may be provided.

Accordingly, the first side chassis 170*a* and the second side chassis 160*a* may have the same shape and be installed in both side portions of the upper door cap 110*a*. That is, the first side chassis 170*a* and the second side chassis 160*a* may form both side surfaces of the door 30*a*. The first side chassis 170*a* and the second side chassis 160*a* may include a first handle portion 174*a* (see FIG. 31) including a first grip space 1741*a* and a second handle portion 164*a* (see FIG. 32), respectively.

The chassis unit 300*a* may be detachably coupled to the door body 100*a*. The chassis unit 300*a* may include a trim installing chassis 310*a*, a deco trim 320*a*, and a cap door 330*a*.

The lower door cap 120*a* of the refrigerator according to another embodiment of the disclosure may also include a lower cap body and a lower cap protrusion 122*a*. Accordingly, a lower trim of the door panel 200*a* may be inserted in the lower cap protrusion 122*a* and rotate to be coupled to the door body 100*a*. Accordingly, a method for installing the door panel 200*a* may be the same as that used in the refrigerator according to an embodiment of the disclosure.

The upper cap trim 150*a* of the refrigerator according to another embodiment of the disclosure may cover both an upper portion of the chassis unit 300*a* and an upper portion of the upper door cap 110*a*. Details about this will be described below.

Figure 25:
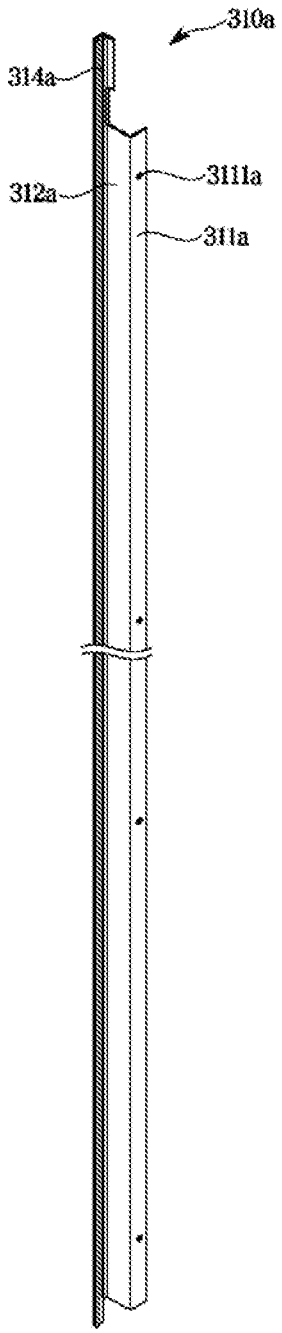
FIG. 25 shows a trim installing chassis shown in FIG. 24.
Figure 26:
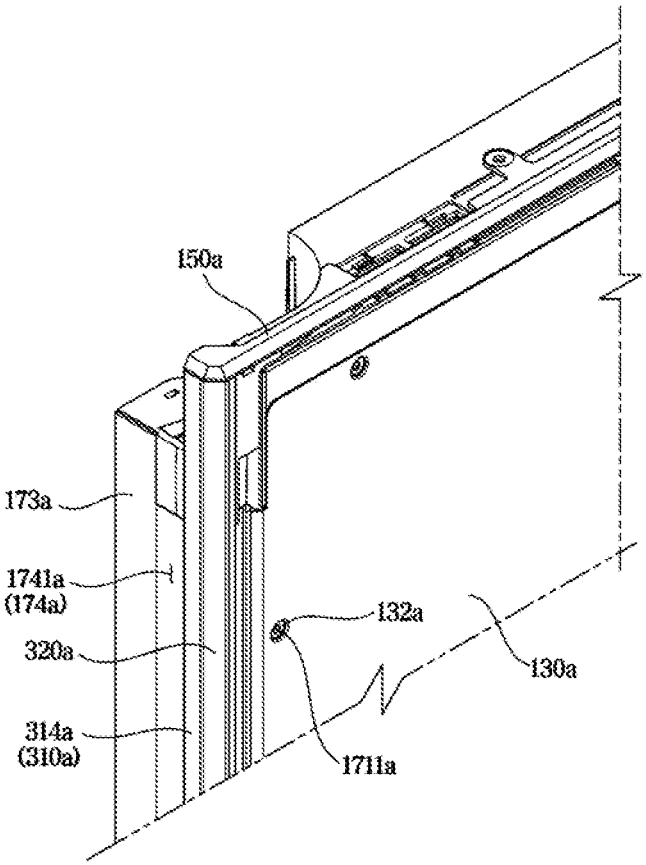
FIG. 26 is an enlarged view showing a state in which the chassis unit is coupled to the door body shown in FIG. 23 from above.
Figure 27:
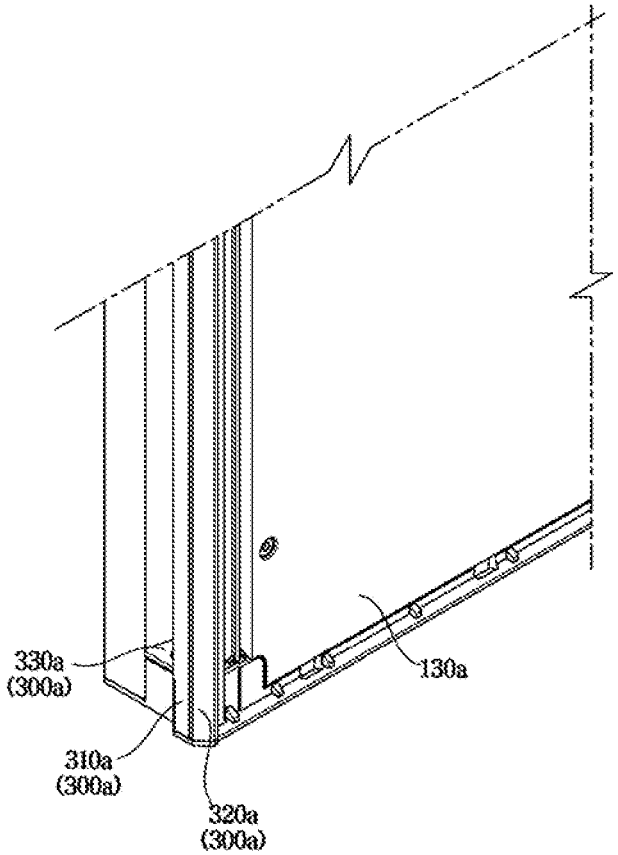
FIG. 27 is an enlarged view showing a state in which the chassis unit is coupled to the door body shown in FIG. 23 from below.

FIG. 25 shows a trim installing chassis shown in FIG. 24. FIG. 26 is an enlarged view showing a state in which the chassis unit is coupled to the door body shown in FIG. 23 from above. FIG. 27 is an enlarged view showing a state in which the chassis unit is coupled to the door body shown in FIG. 23 from below.

Referring to FIG. 25, a trim installing chassis 310*a* may include a chassis coupling portion 311*a*, an extension portion 312*a*, and a trim coupling portion 314*a*.

The chassis coupling portion 311*a* of the trim installing chassis 310*a* may cover an inner side of the first handle portion 174*a* of the first side chassis 170*a* which will be described below. In the chassis coupling portion 311*a* of the trim installing chassis 310*a*, a chassis coupling hole 3111*a* may be formed such that the trim installing chassis 310*a* is coupled to the first side chassis 170*a* through a coupling member.

The extension portion 312*a* of the trim installing chassis 310*a* may be bent from the chassis coupling portion 311*a* and extend. The extension portion 312*a* of the trim installing chassis 310*a* may cover the inner side of the first handle portion 174*a* of the first side chassis 170*a*. That is, because the chassis coupling portion 311*a* and the extension portion 312*a* of the trim installing chassis 310*a* have a shape corresponding to the first handle portion 174*a* depressed toward an inner portion of the first side chassis 170*a*, the chassis coupling portion 311*a* and the extension portion 312*a* may be not exposed to a user who sees the chassis coupling portion 311*a* and the extension portion 312*a* from the front.

The trim coupling portion 314*a* of the trim installing chassis 310*a* may be bent from the extension portion 312*a* and protrude in a side direction of the first side chassis 170*a*.

Details about a coupling relationship between the trim installing chassis 310*a* and the first side chassis 170*a* will be described below.

FIGS. 26 and 27 show a state in which the chassis unit 300*a* is installed in the door body 100*a* from above and from below.

Referring to FIG. 26, the trim installing chassis 310*a* and the deco trim 320*a* may be installed in the first handle portion 174*a* of the first side chassis 170*a*, in which the first grip space 1741*a* is formed. Also, the upper cap trim 150*a* may cover open upper portions of the trim installing chassis 310*a* and the deco trim 320*a*.

Referring to FIG. 27, the cap door 330*a* of the chassis unit 300*a* may be installed on one side of the lower door cap 120*a* coupled to a lower portion of the first side chassis 170*a*. The trim installing chassis 310*a* and the deco trim 320*a* may be provided in front of the cap door 330*a*.

Figure 28:
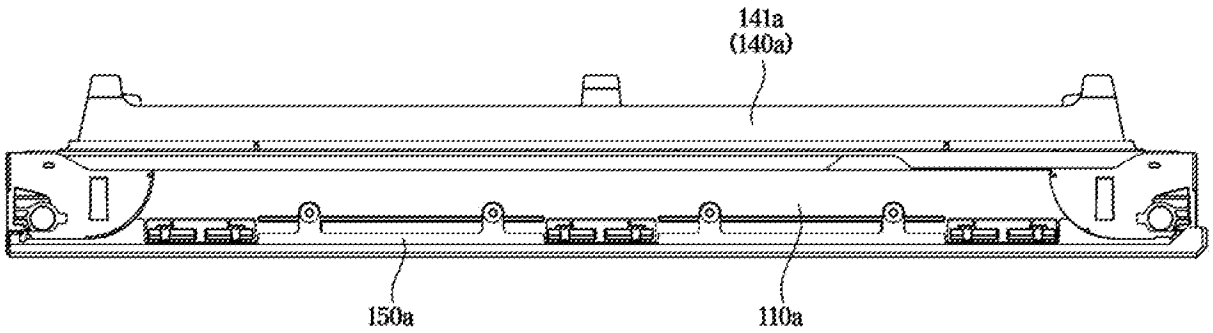
FIG. 28 shows an upper surface of the door shown in FIG. 23.
Figure 29:
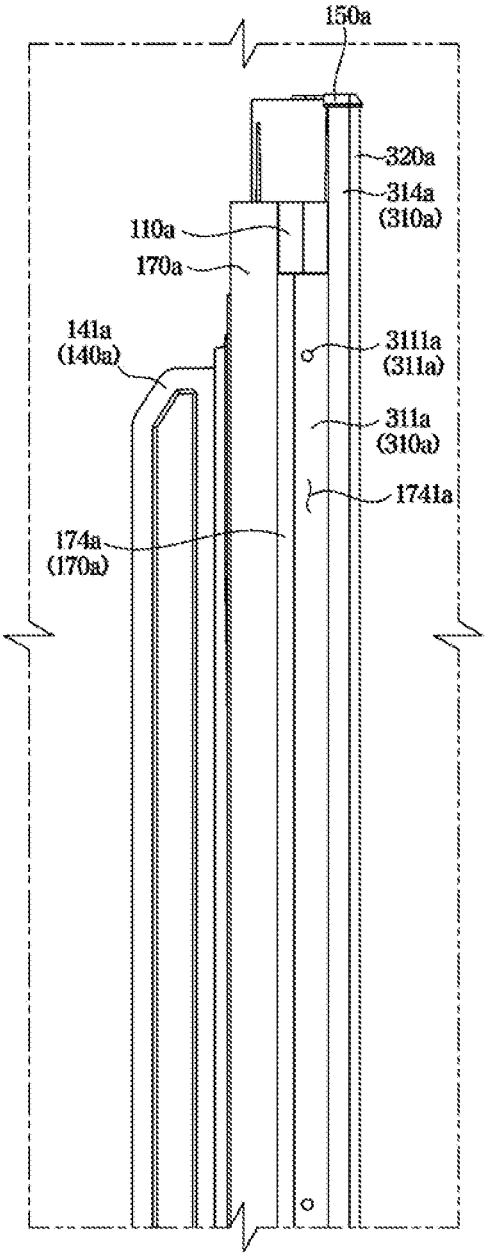
FIG. 29 shows a side surface of the door shown in FIG. 23.

FIG. 28 shows an upper surface of the door shown in FIG. 23. FIG. 29 shows a side surface of the door shown in FIG. 23.

Referring to FIG. 28, the upper cap trim 150*a* may be detachably installed in the upper door cap 110*a*. Accordingly, the upper cap trim 150*a* may form a front upper surface of the door 30*a*.

Referring to FIGS. 28 and 29, the upper cap trim 150*a* may cover the upper portions of the trim installing chassis 310*a* and the deco trim 320*a*.

Also, the chassis coupling portion 311*a* of the trim installing chassis 310*a* may be coupled to the first handle portion 174*a* forming the first grip space 1741*a* of the first side chassis 170*a* through the chassis coupling hole 3111*a*.

Figure 30:
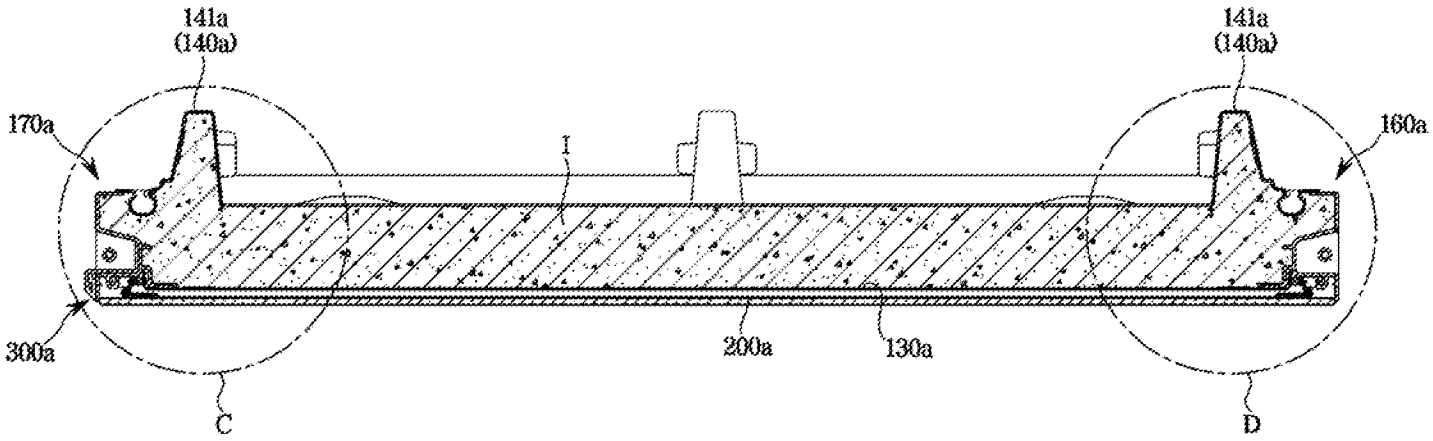
FIG. 30 is a cross-sectional view of the door shown in FIG. 23.
Figure 31:
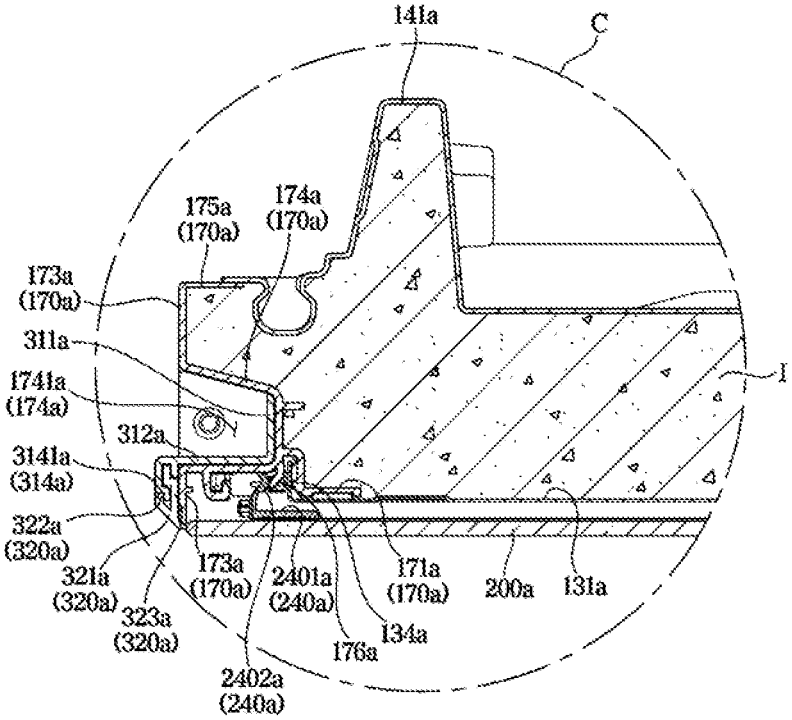
FIG. 31 is an enlarged view of a C area of FIG. 30.
Figure 32:
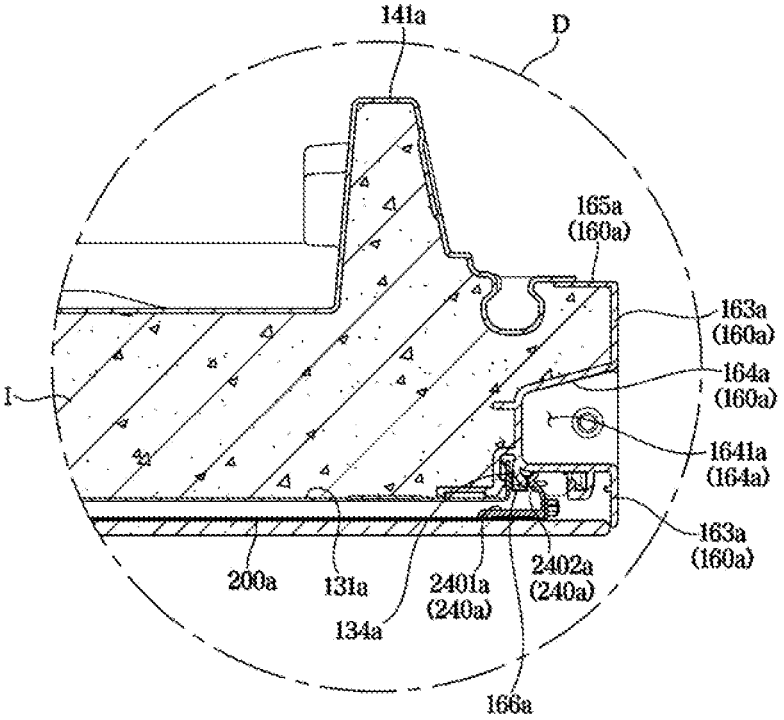
FIG. 32 is an enlarged view of a D area of FIG. 30.

FIG. 30 is a cross-sectional view of the door shown in FIG. 23. FIG. 31 is an enlarged view of a C area of FIG. 30. FIG. 32 is an enlarged view of a D area of FIG. 30.

As shown in FIG. 30, the door body 100*a* of the refrigerator according to another embodiment of the disclosure may include the first side chassis 170*a* at one side and the second side chassis 160*a* at the other side to form side surfaces of the door 30*a* and the door body 100*a*.

The first side chassis 170*a* and the second side chassis 160*a* may be symmetrical to each other. The chassis unit 300*a* may be coupled to a side in which the first side chassis 170*a* is provided to form a side edge of the door panel 200*a*.

Referring to FIG. 31, the first side chassis 170*a* may be provided between the cover plate 130*a* and the rear frame 141*a* to form one side surface of the door body 100*a*.

The first side chassis 170*a* may include a first cover support portion 171*a* supporting the cover plate 130*a*. The first cover support portion 171*a* may extend toward the cover plate 130*a* to support a rear surface of the cover body 131*a* of the cover plate 130*a*.

The first side chassis 170*a* may include a first side portion 173*a* and the first handle portion 174*a*. The first side portion 173*a* may form the side surface of the door body 100*a*. The first handle portion 174*a* may be formed by being depressed inward from the first side portion 173*a*. The first handle portion 174*a* may include the first grip space 1741*a* capable of being gripped by a user.

The first side chassis 170*a* may include a first frame coupling portion 175*a*. The first frame coupling portion 175*a* may be bent inward from the first side portion 173*a* to be in contact with the rear frame 141*a*.

The first side chassis 170*a* may include a first panel fixing portion 176*a* formed on a front surface of the first handle portion 174*a*.

The door panel 200*a* may include a side trim 240*a*. The side trim 240*a* may include a side trim body 2401*a* and a side trim protrusion 2402*a* extending in the rear direction from the side trim body 2401*a*. The side trim protrusion 2402*a* may be elastically supported by the first panel fixing portion 176*a*.

The trim installing portion 310*a* of the chassis unit 300*a* may be coupled to the inner portion of the first handle portion 174*a*. The chassis coupling portion 311*a* and the extension portion 312*a* of the trim installing chassis 310*a* may be bent to correspond to a shape of the first handle portion 174*a*.

The trim coupling portion 314*a* of the trim installing chassis 310*a* may extend outward from the extension portion 312*a* and protrude in a side direction from the first side portion 173*a* of the first side chassis 170*a*.

Because the trim coupling portion 314*a* protrudes in the side direction from the first side portion 173*a*, a space in which the deco trim 320*a* is coupled to the trim installing chassis 310*a* may be formed.

The trim coupling portion 314*a* may include a protrusion inserting groove 3141*a*.

The deco trim 320*a* may include a deco portion 321*a* forming an edge of the door panel 200*a* in one side of the door panel 200*a*. Also, the deco trim 320*a* may include a guide protrusion 322*a* extending in the rear direction from the deco portion 321*a*, and a slide portion 323*a*.

The guide protrusion 322*a* of the deco trim 320*a* may be inserted in the protrusion inserting groove 3141*a* of the trim coupling portion 314*a*. Also, the slide portion 323*a* of the deco trim 320*a* may be caught by an inner portion of the chassis coupling portion 311*a* of the trim coupling portion 314*a* to assist a sliding movement of the deco trim 320*a*.

Accordingly, an insulation may be foamed between the first side chassis 170*a*, the rear frame 141*a*, and the cover plate 130*a* to form the door body 100*a*. Nevertheless, because the chassis unit 300*a* is detachably coupled to an outer portion of the first side chassis 170*a*, the deco trim 320*a* may be installed as necessary.

Referring to FIG. 32, the second side chassis 160*a* may be provided between the cover plate 130*a* and the rear frame 141*a* to form the side surface of the door body 100*a*.

The second side chassis 160*a* may include a second cover support portion 161*a* supporting the cover plate 130*a*. The second cover support portion 161*a* may extend toward the cover plate 130*a* to support a rear surface of the cover body 131*a* of the cover plate 130*a*.

The second side chassis 160*a* may include a second side portion 163*a* and a second handle portion 164*a*. The second side portion 163*a* may form the side surface of the door body 100*a*. The second handle portion 164*a* may be depressed inward from the second side portion 163*a*. The second handle portion 164*a* may include a second grip space 1641*a* capable of being gripped by a user.

The second side chassis 160*a* may include a second frame coupling portion 165*a*. The second frame coupling portion 165*a* may be bent inward from the second side portion 163*a* to be in contact with the rear frame 141*a*.

The second side chassis 160*a* may include a second panel fixing portion 166*a* formed on a front surface of the second handle portion 164*a*.

The door panel 200*a* may include a side trim 240*a*. The side trim 240*a* may include a side trim body 2401*a* and a side trim protrusion 2402*a* extending in the rear direction from the side trim body 2401*a*. The side trim protrusion 2402*a* may be elastically supported by the second panel fixing portion 166*a*.

FIGS. 33 to 37 show a process for assembling a chassis unit and a door panel with a door body of a refrigerator according to another embodiment of the disclosure.

Figure 33:
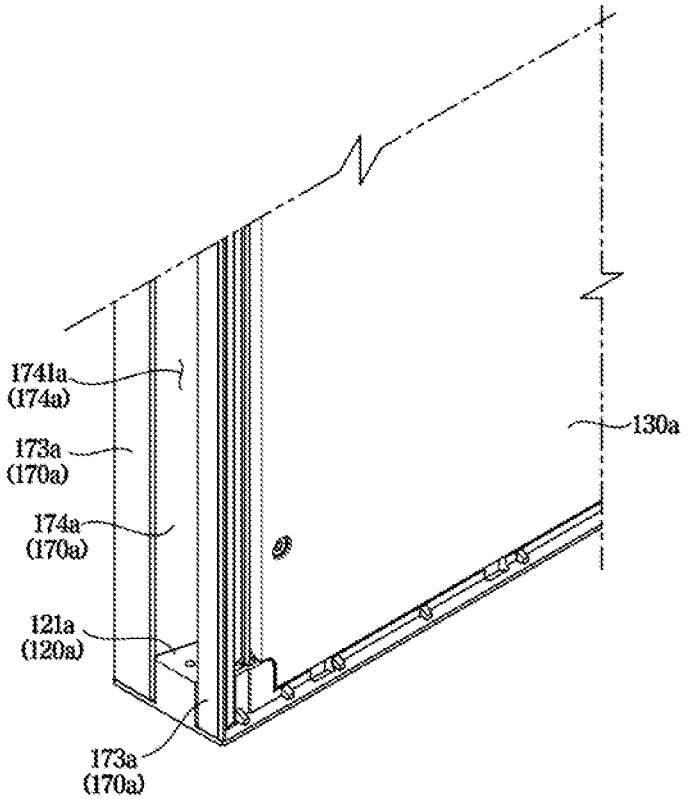
FIGS. 33 to 37 show a process for assembling a chassis unit and a door panel with a door body of a refrigerator according to another embodiment of the disclosure.

FIG. 33 shows a state in which no element and/or component are/is coupled to the door body 100*a*.

Referring to FIG. 33, the lower door cap 120*a* provided in a lower area of the first grip space 1741*a* may include a cap door installing portion 121*a*.

Figure 34:
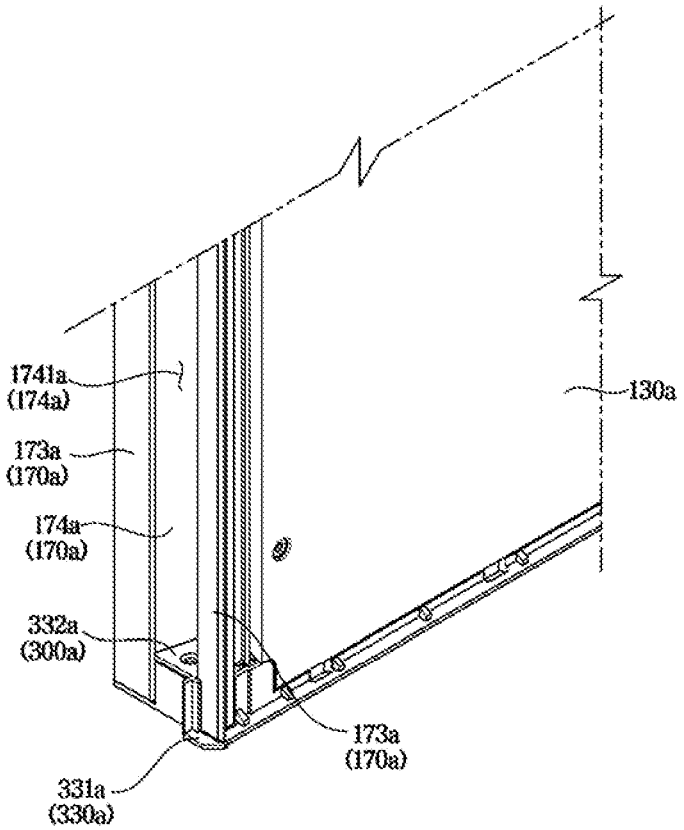

Referring to FIGS. 33 and 34, a cap door 330*a* may be installed in the cap door installing portion 121*a* of the lower door cap 120*a*.

The cap door 330*a* may include a cover portion 331*a* and a support portion 332*a*. The support portion 332*a* may cover the cap door installing portion 121*a* of the lower door cap 120*a*. The cover portion 331*a* may extend from the support portion 332*a* and have the same height as a bottom surface of the door 30*a*. The cover portion 331*a* may cover a sharp cut surface of a lower portion of the chassis unit 300*a* to prevent a user from being injured.

Figure 35:
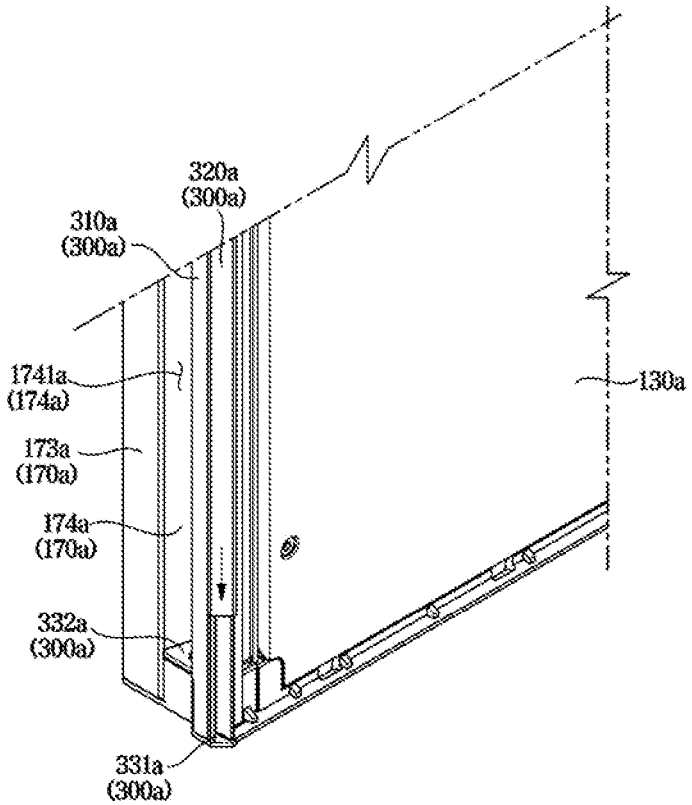

Referring to FIGS. 34 and 35, the trim installing chassis 310*a* may be rested on an upper surface of the cover portion 331*a* of the cap door 330*a*. Then, the trim installing chassis 310*a* may be coupled to the inner side of the first handle portion 174*a* of the first side chassis 170*a*. More specifically, the trim installing chassis 310*a* may be coupled to the first side chassis 170*a* at a side portion.

Then, the deco trim 320*a* may be slidingly coupled to the trim installing chassis 310*a* along the chassis coupling portion 311*a* of the trim installing chassis 310*a*. After a movement of the deco trim 320*a* is completed, a lower portion of the deco trim 320*a* may also be rested on the upper surface of the cover portion 331*a* of the cap door 330*a*.

Figure 36:
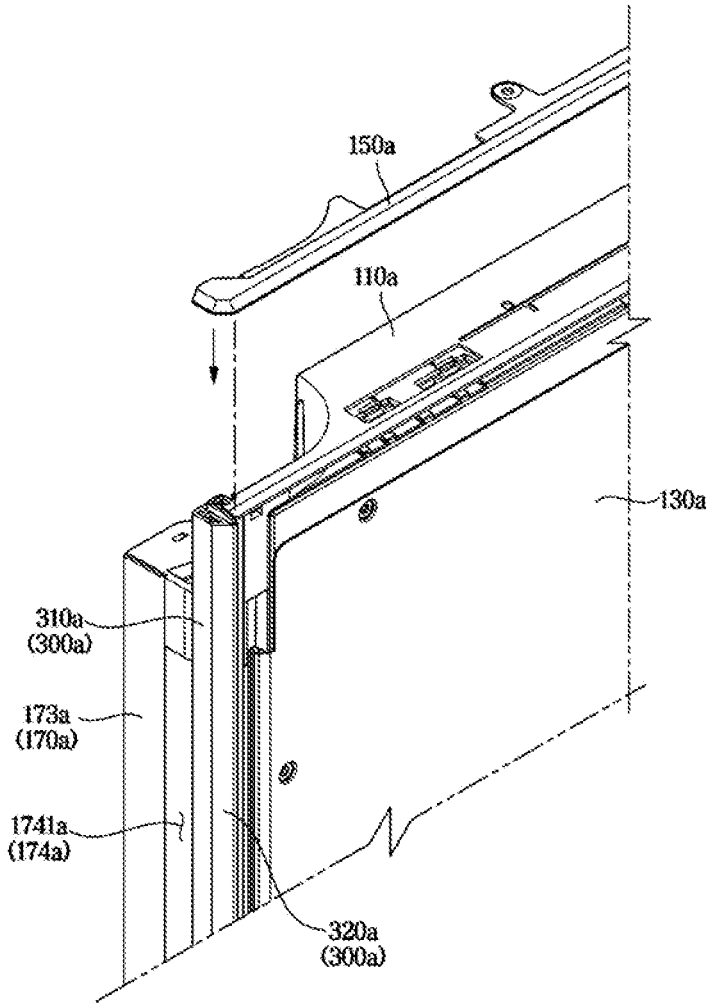

Referring to FIG. 36, the trim installing chassis 310*a* may be coupled to the first side chassis 170*a*, and the deco trim 320*a* may be coupled to the trim installing chassis 310*a*. In this state, the upper cap trim 150*a* may be coupled to the trim installing chassis 310*a* and the deco trim 320*a* to cover the open upper portions of the trim installing chassis 310*a* and the deco trim 320*a*. The upper cap trim 150*a* may be coupled to the upper door cap 110*a* and fixed.

Figure 37:
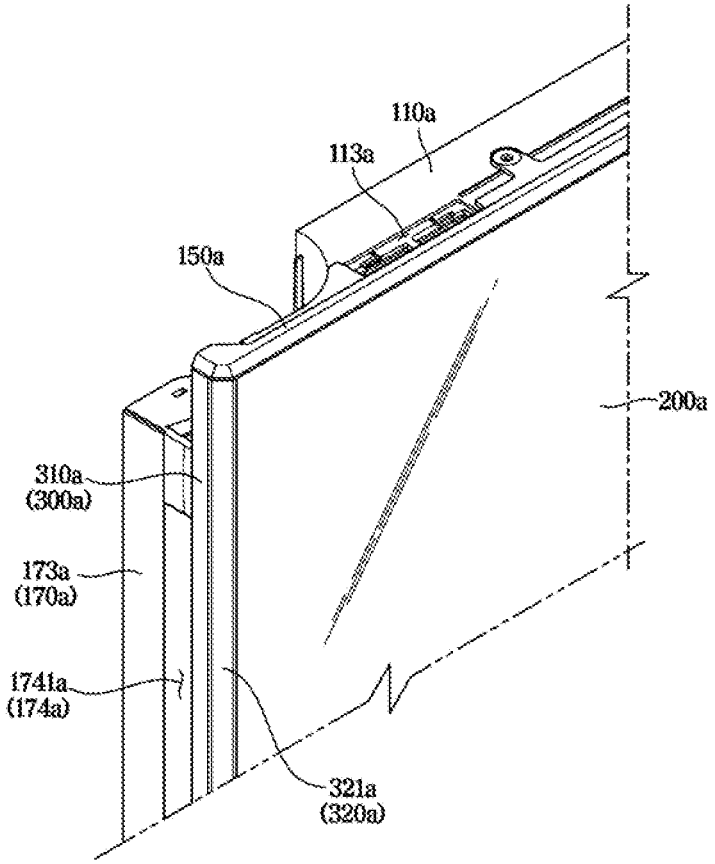

Referring to FIGS. 36 and 37, after the chassis unit 300*a* is coupled to the door body 100*a*, the door panel 200*a* may be coupled to a front portion of the door body 100*a*.

A method for coupling the door panel 200*a* has been described above with reference to the refrigerator according to an embodiment of the disclosure. After the lower trim of the door panel 200*a* is fixed to the side trim, a separate fixing member may be coupled through the through opening 113*a* of the upper door cap 110*a*, and accordingly, the upper trim of the door panel 200*a* may be fixed to the upper door cap 110*a*.

Accordingly, a side edge of the door panel 200*a* may be formed by the deco trim 320*a*, and an upper edge of the door panel 200*a* may be formed by the upper cap trim 150*a*.

So far, specific embodiments have been shown and described, however, the disclosure is not limited to these embodiments. It should be interpreted that various modifications may be made by one of ordinary skill in the technical art to which the disclosure belongs, without deviating from the gist of the technical concept of the disclosure, which is defined in the following claims.

What is claimed is:

1. A refrigerator comprising:

a main body having a storage chamber within the main body; and a door including:

a door body having an insulation inside the door body, the door body being rotatably coupled to the main body so that the door is rotatable to open and close the storage chamber, a trim installing chassis detachably coupled to the door body and forming a side surface of the door, the trim installing chassis including a trim coupling portion protruding outward from the door, and the trim coupling portion including a protrusion inserting groove longitudinally extending from a top end of the trim installing chassis to a bottom end of the trim installing chassis, a deco trim including a guide protrusion longitudinally extending from a top end of the deco trim to a bottom end of the deco trim and that is insertable into the protrusion inserting groove so that, when the guide protrusion is inserted into the protrusion inserting groove, the guide protrusion is slidable in the protrusion inserting groove in a longitudinal direction of the protrusion inserting groove to couple the deco trim to the trim coupling portion and so that, when the deco trim is coupled to the trim coupling portion, the deco trim forms an edge of the door, and a door panel that, with the deco trim coupled to the trim coupling portion and forming the edge of the door, is detachably couplable to the door body so that the door panel forms a front surface of the door, and the door panel and the deco trim together form a front outer appearance of the door, wherein, when the deco trim is coupled to the trim coupling portion and the door panel is coupled to the door body, the deco trim does not extend over the front surface.

2. The refrigerator of claim 1, wherein the edge formed by the deco trim is a side edge of the door, and, when the deco trim is coupled to the trim coupling portion, the deco trim extends along a direction of a rotation axis on which the door rotates.

3. The refrigerator of claim 1, wherein the door body further includes:

a cover plate forming a front surface and a side surface of the door body, wherein the trim installing chassis is coupled to a side of the cover plate, and the cover plate is positioned so that, when the door panel is coupled to the door body, the cover plate is behind the door panel, and a rear unit positioned behind the cover plate and forming a rear surface of the door body.

4. The refrigerator of claim 3, wherein the door body further includes:

a side chassis including a side portion forming another side surface of the door opposite the trim installing chassis between the rear unit and the cover plate.

5. The refrigerator of claim 4, wherein the side of the cover plate is coupled to the rear unit to form the side surface of the door body, and another side of the cover plate is coupled to the side chassis.

6. The refrigerator of claim 4, wherein the side chassis includes a handle portion depressed from the side portion toward inside of the door.

7. The refrigerator of claim 3, wherein the cover plate includes:

a chassis coupling portion to which the trim installing chassis is coupled, and an extension portion extending in a rear direction from the chassis coupling portion to form the side surface of the door body or a surface opposite the side surface of the door body.

8. The refrigerator of claim 7, wherein the trim installing chassis includes a cover coupling portion coupled to the chassis coupling portion, and the trim coupling portion extends outward from the cover coupling portion and protrudes in a side direction from the extension portion of the cover plate.

9. The refrigerator of claim 8, wherein the trim installing chassis further includes a side portion extending from the trim coupling portion to be parallel to the extension portion of the cover plate, and forming the side surface of the door.

10. The refrigerator of claim 9, wherein the trim installing chassis further includes a chassis fixing portion bent from the side portion toward inside of the door, and the chassis fixing portion includes an end portion that is inserted in the rear unit.

11. The refrigerator of claim 10, wherein the rear unit includes a rear frame including a support groove depressed in a rear portion of the rear frame, and the chassis fixing portion is inserted in the support groove.

12. The refrigerator of claim 8, wherein the door panel includes a side trim, the trim installing chassis includes a panel fixing portion extending in a front direction from the cover coupling portion, and, when the door panel is coupled to the door body, the panel fixing portion contacts the side trim so as to fix a location of the door panel with respect to the door body.

13. The refrigerator of claim 1, wherein the door further includes:

a sub trim to cover upper portions of the trim installing chassis and the deco trim.

14. The refrigerator of claim 1, wherein the door body includes a plurality of side chassis forming opposite side surfaces of the door, each side chassis of the plurality of side chassis including a handle portion depressed to inside of the door, so that the trim installing chassis is coupled to the handle portion of each side chassis of the plurality of side chassis.

15. A refrigerator comprising:

a main body having a storage chamber within the main body; and a door including:

a door body having an insulation inside the door body, the door body being rotatably coupled to the main body so that the door is rotatable to open and close the storage chamber, a trim installing chassis detachably coupled to the door body and forming a side surface of the door, the trim installing chassis including a trim coupling portion protruding outward from the door, and the trim coupling portion including a protrusion inserting groove, a deco trim including a guide protrusion that is insertable into the protrusion inserting groove so that, when the guide protrusion is inserted into the protrusion inserting groove, the guide protrusion is slidable in the protrusion inserting groove to couple the deco trim to the trim coupling portion and so that, when the deco trim is coupled to the trim coupling portion, the deco trim forms an edge of the door, and a door panel that, with the deco trim coupled to the trim coupling portion and forming the edge of the door, is detachably couplable to the door body so that the door panel forms a front surface of the door, and the door panel and the deco trim together form a front outer appearance of the door, wherein the door body includes a plurality of side chassis forming opposite side surfaces of the door, each side chassis of the plurality of side chassis including a handle portion depressed to inside of the door, so that the trim installing chassis is coupled to the handle portion of each side chassis of the plurality of side chassis.

16. A refrigerator comprising:

a main body having a storage chamber within the main body; and a door including:

a door body having an insulation inside the door body, the door body being rotatably coupled to the main body so that the door is rotatable to open and close the storage chamber, a trim installing chassis detachably coupled to the door body and forming a side surface of the door, the trim installing chassis including a trim coupling portion protruding outward from the door, and the trim coupling portion including a protrusion inserting groove, a deco trim including a guide protrusion that is insertable into the protrusion inserting groove so that, when the guide protrusion is inserted into the protrusion inserting groove, the guide protrusion is slidable in the protrusion inserting groove to couple the deco trim to the trim coupling portion and so that, when the deco trim is coupled to the trim coupling portion, the deco trim forms an edge of the door, and a door panel that, with the deco trim coupled to the trim coupling portion and forming the edge of the door, is detachably couplable to the door body so that the door panel forms a front surface of the door, and the door panel and the deco trim together form a front outer appearance of the door, wherein, when the deco trim is coupled to the trim coupling portion and the door panel is coupled to the door body, the deco trim does not extend over the front surface.

* * * * *